US009878255B2

(12) United States Patent
Kriticos

(10) Patent No.: US 9,878,255 B2
(45) Date of Patent: Jan. 30, 2018

(54) SURFING DEVICE AND METHOD

(71) Applicant: Whitewater West Industries Ltd., Richmond (CA)

(72) Inventor: Stephen Con Kriticos, Manly (AU)

(73) Assignee: WHITEWATER WEST INDUSTRIES LTD., Richmond, BC (CA)

( * ) Notice: Subject to any disclaimer, the term of this patent is extended or adjusted under 35 U.S.C. 154(b) by 0 days.

(21) Appl. No.: 15/350,379

(22) Filed: Nov. 14, 2016

(65) Prior Publication Data

US 2017/0136370 A1 May 18, 2017

Related U.S. Application Data

(60) Provisional application No. 62/255,159, filed on Nov. 13, 2015.

(51) Int. Cl.
*A63G 31/00* (2006.01)
*A63G 33/00* (2006.01)

(52) U.S. Cl.
CPC ..... *A63G 31/007* (2013.01)

(58) Field of Classification Search
CPC ..... A63G 21/00; A63G 21/18; A63G 31/00; A63G 31/007; A63G 33/00; A63C 19/00; A63C 19/10
USPC ..... 472/88–91, 117, 128, 129
See application file for complete search history.

(56) References Cited

U.S. PATENT DOCUMENTS 4,976,422 A * 12/1990 Shimamura ..... A63C 19/10 472/90
5,540,622 A * 7/1996 Gold ..... A63G 21/18 472/117
6,527,646 B1 * 3/2003 Briggs ..... A63G 33/00 104/69
6,758,231 B1 * 7/2004 Lochtefeld ..... A63G 3/00 104/70
2008/0293505 A1 * 11/2008 Northam ..... A63G 31/007 472/90

* cited by examiner

*Primary Examiner* — Kien Nguyen
(74) *Attorney, Agent, or Firm* — Joshua C. Malino; Greenberg Traurig, LLP

(57) ABSTRACT

The present invention discloses a surfing device comprising at least one energy projector for projecting energy, at least one energy recycling mechanism for recycling at least some of the projected energy, and at least one energy projecting structure. The energy projecting structure is configured for supporting the energy projector to provide a plurality of energy projecting positions for the projection of energy therefrom. The projected energy provides a simulated surfing surface, positioned a distance from the plurality of energy projecting positions. The energy projecting structure is also configured for supporting the energy recycling mechanism for projecting recycled energy from one or more recycled projection positions. The energy projector and energy recycling mechanisms are configured for the projection of corresponding energy to enable a surfer to surf upon the virtual surfing surface at least partially via the energy projected from both the energy projecting positions and the recycled projection positions.

13 Claims, 21 Drawing Sheets

SURFING DEVICE AND METHOD

CROSS REFERENCE TO RELATED APPLICATION

This application claims the benefit of priority under 35 U.S.C. § 119(e) to Provisional Application No. 62/255,159, filed on Nov. 13, 2015, which is incorporated by reference in its entirety.

BACKGROUND

Field of the Invention

The present invention relates to the water sports of surfing and skiing and in particular to surfing or skiing simulation. The present invention is not limited to simulation of typical surfing or skiing using a convention surf board or boogie board, or conventional skis.

SUMMARY

The present invention is related to water surfing or skiing simulation. In one embodiment, a surfing device may comprise at least one energy projecting means for projecting energy on a surface, at least one energy recycling means for recycling at least some energy of the projected energy, and at least one corresponding energy projecting structure. The energy projecting structure may be configured for supporting the energy projecting means to provide a plurality of energy projecting positions for projecting energy therefrom. The energy projecting means may be configured to project energy from the plurality of energy projecting positions to provide a simulated surfing surface, positioned a distance from and relative to each of the plurality of energy projecting positions, in the direction of projection of the energy. The energy projecting structure also may be configured for supporting the energy recycling means for projecting recycled energy from one or more recycled projection positions. The energy projecting means and energy recycling means are configured for the projection of corresponding energy from the respective plurality of energy projecting positions and recycled projection positions to enable a surfer to surf upon the virtual surfing surface at least partially via the energy projected from both the energy projecting positions and the recycled projection positions.

In one embodiment, the recycled projection positions are additional to the energy projecting positions. In one embodiment, the additional recycled projection positions are positioned remotely from the plurality of energy projecting positions. In an alternative embodiment, the recycled projection positions include other additional recycled projection positions comprising one or more of the plurality of energy projecting positions, or projection positions proximal to the one or more of the plurality of energy projecting positions. In another embodiment, the surfing device comprises the additional and other additional recycled projection positions.

In one embodiment, the energy recycling means comprises an energy recycling module. The energy recycling module connects to the energy projecting structure. In an alternative embodiment, the energy recycling means comprises an energy recycling device which is configured to connect to the energy projecting structure. In another embodiment, the energy recycling means comprises an energy recycling apparatus and the apparatus being connectable to the energy projecting structure. The energy recycling means is configured to recycle static or dynamic energy, or both. In one embodiment, the energy recycling means is configured to recycle static or dynamic fluid pressure, or both. In another embodiment, the recycled projection from any of the one or more of plurality of energy projecting positions is configured to at least partially overcome any one or more forces which at least partially impairs the surfer's surfing experience, for example, gravity or friction.

The one or more additional energy projecting positions are positioned at a predetermined additional energy projecting region, and the predetermined additional energy projecting region being proximal to a predetermined region of the virtual surfing surface. In one embodiment of the surfing device, the predetermined region is positioned at or near a front region of the virtual surfing surface wherein the front region is a region where the recycled projection from the additional recycled projection positions has a greater velocity. In one embodiment, the surfing device is configured to project energy from the other additional recycled projection positions with a lower velocity proximal to the front region and a higher velocity the more removed from the front region. In another embodiment, the energy projected from the plurality of energy projecting positions has a lower velocity proximal to the front region and a higher velocity the more removed from the front region.

In one embodiment, the virtual surfing surface is positioned at a predetermined distance relative to each of the plurality of energy projecting positions.

In another aspect of the present invention, there is provided a surfing device kit of parts comprising: (a) components for construction of at least one energy projecting means for projecting energy, at least one energy recycling means for recycling at least some energy of the projected energy and at least one corresponding energy projecting structure, and the at least one energy projecting structure being configured to support and position the energy projecting means to provide a plurality of energy projecting positions for energy projection therefrom and the energy projecting means being configured to project energy to provide a virtual surfing surface positioned relative to each of the plurality of energy projecting positions a distance therefrom in a direction of the energy projection, the energy projecting structure also being configured for supporting the energy recycling means for projecting recycled energy projection from one or more recycled projection positions; and (b) instructions for assembly of the components to construct the energy projecting structure, energy projecting means and energy recycling means and to support and position the energy projecting means and energy recycling means for projection of corresponding energy from the respective plurality of energy projecting positions and the one or more recycled projection positions to enable a surfer to surf upon the virtual surfing surface at least partially via energy projected from both the energy projecting positions and recycled projection positions.

In one embodiment of the surfing device kit of parts, the recycled projection positions are additional to the plurality of energy projecting positions. In another embodiment, the additional recycled projection positions are also positioned remotely from the plurality of energy projecting positions. In another embodiment, the recycled projection positions comprise other additional recycled projection positions comprising one or more of the plurality of energy projecting positions, or projection positions proximal to the one or more of plurality of energy projecting positions. In still another embodiment, the surfing device kit of parts comprises the additional and other additional recycled projection positions. The instructions for assembly of the components further comprise instructions for one or more of the following: assembly of the energy projecting means; assembly of the energy recycling means; assembly of the energy projecting structure and energy projecting means for projection of energy by the energy projecting means from the one or more positions to enable a person to surf at least partially via the projected energy; assembly of the energy recycling means for projection of energy from one or more of the one or more recycled projection positions.

In one embodiment, the energy projecting means and energy projecting structure are configured to enable a person to surf at least substantially via the projected energy. The surfing is enabled by interaction of the person and the person's surfboard or boogie board, with the projected energy. One or more of the energy projecting means and energy projecting structure are configured to simulate an ocean wave. In this embodiment, the person surfs at least essentially naturally upon the virtual surfing surface. In one embodiment, the essentially natural surfing is essentially equivalent to surfing an ocean wave.

In another embodiment, the energy projecting means is further configured to project energy from a position proximal to the virtual surfing surface. The proximal position is removed from the virtual surfing surface by a distance ranging from approximately 5 to 50 millimeters, or preferably removed by a distance ranging from approximately 10 to 25 millimeters.

One or more of the energy projecting means and energy recycling means, and the corresponding energy projecting structure, are configured to project energy at a given instant only from specific energy projecting positions. The specific energy projecting positions may comprise a single position. The specific energy projecting positions may also comprise a single position and a predetermined number of other of the plurality of energy projecting positions which are proximal to the single position. In one embodiment, one or more of the energy projecting means and energy recycling means or energy projecting structure, or both, is configured to coincide the specific energy projection or recycled energy projection, or both, with a position of a surfer at the given instant. In another embodiment, the surfing device is configured to predict the surfer's instantaneous position. Prediction of the surfer's instantaneous position is achieved using one or more of algorithms, the surfer's movement, and/or one or more of the surfer's previous positions.

The surfing device further comprises a safety surface and the corresponding kit of parts comprising components for constructions of the safety surface, wherein the safety surface is configured to support a person upon completion of the surfing. The instructions comprise instructions for one or more of the following: assembly of the safety surface; assembly of the energy projecting structure and safety surface for supporting a person upon completion of the surfing.

In one embodiment, the energy projecting means or the energy recycling means, or both, is configured to project fluid. The energy projecting means or the energy recycling means, or both, comprises energy projecting outlets, for example, nozzles. In an alternative embodiment, the energy projecting means or the energy recycling means, or both, is configured to project electromagnetic energy. In yet another embodiment, the energy projecting means or the energy recycling means, or both, is configured to project a combination of one or more of these and suitable alternative forms of energy. The energy projecting means or the energy recycling means, or both, is configured to provide an efficient method of transfer of energy to the person/surfer.

The energy projecting means is configured to project energy amount ranging from approximately 1,470.9975 Pascal ("Pa") to 4,903.325 Pa. The energy recycling means is configured to project energy amount ranging from approximately 1,470.9975 Pa to 4,903.325 Pa.

The energy projecting means is configured to project energy at an angle ranging from approximately 5 to 35 degrees relative to a tangential plane that is tangential to the surface. However, the angle of projection ranges from approximately 10 to 35 degrees. In one embodiment, the energy projecting means is configured to project energy at an angle ranging from approximately 5 to 25 degrees relative to the tangential plane.

The additional energy recycling means is configured to project energy at an angle ranging from approximately 5 to 35 degrees relative to a tangential plane that is tangential to the surface. The other additional energy recycling means is configured to project energy at an angle ranging from approximately 5 to 175 degrees relative to a tangential plane that is tangential to the surface.

In one embodiment, the energy projection means or the energy recycling means, or both, is further configured for at least partially continuous projection of energy in the form of fluid. In another embodiment, the energy projecting means comprises substantially fluid projecting means.

The surfing device further comprises a fluid relief means and the corresponding kit of parts comprising components for constructions of the fluid relief means wherein the fluid relief means is configured for removing excess fluid from the surface. The instructions for component assembly comprise instructions for one or more of the following: assembly of the fluid relief means; assembly of the energy projecting structure and the fluid relief means for the excess fluid removal. The excess fluid is fluid that interacts adversely with surfing. The fluid relief means may be configured to modify the surfing. This modification may be configured to alter a level of difficulty of the surfing. The fluid relief means may be configured to alter, for example, one or more of at least the following characteristics of the surfing: drag, fluid projection angle, penetration of the projected fluid.

In one embodiment, the fluid relief is adjustable, either statically or dynamically or both. Static adjustment may comprise adjustment that is performed when the device is temporarily out of operation. Contrastingly, dynamic adjustment may comprise adjustment that is performed during surfing. The static and dynamic adjustment may each occur manually by manual adjustment of corresponding controls. However, the static and dynamic adjustment may be automated. In one embodiment, the fluid relief is independently adjustable at different positions of the surface so that it can be set at different values at different positions. The adjustment is effected by reducing or increasing the fluid relief which may comprise varying a restriction of the fluid relief.

A reduction or increase in the fluid relief respectively increases or decreases drag associated with the surfing. In one embodiment, the fluid relief means is adjusted to simulate forces of an ocean wave by controlling the drag. In another embodiment, the fluid relief means is further configured to enhancing stability of the surfing by controlling the drag.

In another embodiment, the adjustment of the fluid relief means is configured to change the fluid projection angle. By reducing or increasing fluid relief, the fluid projection angle is respectively reduced or increased. The change to fluid projection angle may be at a distance from the surface but it may instead be proximal to the surface.

In another embodiment, the fluid relief means adjustment is configured to substantially maintain transfer of the energy while reducing a distance the energy is transferred from the surface. In another embodiment, the reduced fluid relief bends the projected fluid toward a more acute angle relative to the surface. The bending is substantially equivalent to more uplift in relation to an ocean wave. It is currently understood that the equivalence of the bending and uplift is due to lowering of the person toward the projecting means.

The fluid relief means may be adapted to relieve fluid within a range from approximately 100% to 50% of the projected fluid, the projected fluid comprising either projection from the energy projection means, energy recycling means or both. The fluid relief means may comprise at least one or more of the following: suction or a vacuum, gravity, or centrifugal force.

In another aspect of the present invention, the surface is elongate and configured for surfing along a longitudinal length of the elongate surface.

In one embodiment of the present invention, the energy projecting means, energy recycling means or both is configured to project energy at an angle ranging from approximately 45 degrees to 135 degrees relative to a longitudinal edge of the elongate surface. In another embodiment, the virtual surfing surface is shaped to simulate the shape of an ocean wave. In one embodiment, the longitudinal edge also comprises a lower elongate edge of the surface.

At least one or more of the following features of the device may be adjustable, either statically or dynamically or both: the amount of the projected energy; the projected fluid comprising either projection from the energy projection means, energy recycling means or both; the energy projection angle of the energy projection means, energy recycling means or both; apertures of the outlet, e.g., nozzle; and the shape of the surface. These features may be independently adjustable. A specific feature may be independently adjustable at different positions of the surface so that it can be set at different values at different positions. The static and dynamic adjustment of the features may correspond to static and dynamic fluid relief adjustments and may further comprise manual and automatic adjustment control corresponding to the manual and automatic fluid relief adjustments.

In one embodiment, the surfing device is configured for static adjustment of at least one or more of the following: the position of the energy projecting means, energy recycling means or both; and the energy projection means including its energy projection capacity, energy recycling means including its energy projection capacity, or both. The static adjustment of the energy projecting means may correspond to static fluid relief adjustment. It may further comprise manual and automatic adjustment control corresponding to the manual and automatic fluid relief adjustments.

In another embodiment, the virtual surfing surface is not shaped to simulate the shape of an ocean wave but instead is substantially horizontal. The virtual surfing surface is substantially flat. The surface may be above a body of fluid. The surfing device may further comprise at least one floatation means and the corresponding kit of parts comprising components for constructions of the at least one floatation means configured for supporting the device upon or at least partially within the body of fluid and providing the virtual surfing surface above, or just beneath the surface of, the body of fluid. The instructions for component assembly may further comprise instructions for one or more of the following: assembly of the floatation means; assembly of the energy projecting structure and the floatation means for supporting the device upon or at least partially within the body of fluid. The one or more floatation means may be integrally formed with the surfing device. Alternatively, the floatation means may be connected to the surfing device.

The floatation means may comprises one or more floatation devices. Each of the one or more floatation devices may comprise at least one float. The float may be at least statically adjustable between two or more float positions. In one embodiment, the float is dynamically adjustable. The float may further comprise the statically adjustable float embodiment. In another embodiment, the floatation support configured for providing different regions of the virtual surfing surface at the position is independently adjustable, either statically or dynamically or both.

The static and dynamic float adjustment may correspond to static and the dynamic fluid relief adjustments. It may further comprise manual and automatic adjustment control corresponding to the manual and automatic fluid relief adjustments.

In another embodiment of the present invention, the device further comprises another surfing surface positioned between the plurality of energy projecting positions and the virtual surfing surface. The at least one energy projecting means is configured to project the energy through the other surface. In one embodiment, the virtual surfing surface and other surfing surface coincide.

The floatation means may be substantially uniformly spread underneath the other surface for support thereof. The flotation means may comprise a density of floats ranging from approximately one float per square-meter to approximately 100 floats per square-meter. The float density may depend on one or more of the following: desired characteristics of the device, and float buoyancy. The buoyancy of the floats may range from approximately 40 kg (kgs) per square-meter at 100 millimeters in depth to approximately 300 kg (kgs) per square-meter at 100 millimeters in depth.

The floatation means may be configured to provide a trampoline effect whereby depression of the other surface into the body of fluid results in the surface being subsequently forced upwardly by the body of fluid. The trampoline effect may be configured to at least partially facilitate surfing maneuvers. It may also enhance surfer enjoyment.

In another embodiment, the other surface may further comprise raised regions. The raises regions may provide at least one or more of the following: an obstacle and a ramp.

In one embodiment, the energy projecting structure is further configured for adjustment of a position or shape of either one or more portions or all of the virtual surfing surface either statically or dynamically or both, and the corresponding kit of parts comprising components for the adjustment. The instructions for component assembly further comprise instructions for one or more of the following: assembly of the adjustment components; assembly of the energy projecting structure and the adjustment components for adjustment of a position or shape of either one or more portions or all of the virtual surfing surface either statically or dynamically or both. The positional adjustment may be vertical, horizontal or any combination thereof. The static and dynamic adjustment in relation to the support means may correspond to static and the dynamic fluid relief adjustment. The structure may further comprise manual and automatic adjustment controls corresponding to the manual and automatic fluid relief adjustments. The adjustments via the energy projecting structure may be configured to simulate an ocean wave.

In another embodiment, the structure is further configured to support the fluid relief means. In one aspect of the present invention, the energy projecting structure comprises support cables.

In one embodiment, the other surface comprises an impact absorbing sheet. The other surface may be formed of PVC. It would be readily apparent to a person skilled in the relevant art that other materials could be used instead of PVC. The other surface may be configured to support one or more the persons upon completion of the surfing. In this embodiment, the other surface comprises a safety surface. The support cables may pass underneath the other surface for support thereof. The cables may loop underneath the other support surface.

Any interaction that occurs between the energy and the other surface only occurs subsequent to the enablement of the surfing. The projected energy may be further configured to enable the person to surf upon the virtual surfing surface substantially without contacting the other surface and without the corresponding friction that would otherwise result from the contact. However, in one embodiment where the virtual surfing surface and the other surface coincide, the surfing may occur upon the other surface.

The other surface may be at least partially porous to facilitate drainage of fluid from the surface. The other surface may comprise an impact absorbing material. The other surface (which may be partially deformable) may be configured to at least partially enhance ride safety.

In one embodiment, the at least partially porous material comprises partially porous regions. A fluid relief or drainage ratio, expressed as a ratio of surface area of the other surface that is fluid permeable relative to the remainder of the surface area of the other surface, is preferably in the range of approximately 0.35 to 0.75 square-meter per square-meter, or approximately 35% to 75%.

The at least partially porous regions may comprise apertures. The apertures may be formed by two corresponding pairs of oppositely positioned walls, dividers or strips that collectively define rectangular shaped apertures. The impact absorbing material may be thick in the direction to absorb the impact, for example in the form of a thick pillar or rail, or both. In one embodiment, the form of material suitable for the other surface includes a sheet of the material. The walls, dividers or strips may be integrally formed in a thick sheet of material. Spacing between one pair of the oppositely positioned dividers, strips or walls may range from approximately 3 to 15 millimeters and the other pair (in order to form a square or rectangle) from approximately 15 to 50 millimeters.

The partially porous material, or regions of it, may be configured for different amounts of deformation, and also for differences in other deformation characteristics. In one embodiment, the partially porous surface of the surfing device deforms quickly and the amount of deformation is substantial. In another embodiment, the partially porous surface deforms slowly and the amount of deformation is less. Differences in deformation amounts and other deformation characteristics may be provided by different materials, material thicknesses or densities, or a combination of one or more of these. The deformation may comprise buckling of the walls of the thick sheet of material. In one embodiment, the buckling occurs in an impact barrier.

The cables discussed above may at least partially absorb a fallen rider's impact. In one embodiment, the cables loop under the other surface. The cables are at least partially slack. In the event of the impact of a fallen rider, this slackness enables the cables to at least partially move away from the rider proximal to the point of impact. This away movement at least partially absorbs the impact. However, the away movement may also result in corresponding movement of the cable on either side of the rider and at least partial lifting of the other surface in regions on the either side. The lifting may also contribute to the impact absorption by lifting the weight of the other surface. In another embodiment, the cables partially absorb the fallen rider's impact and the impact is primarily absorbed by the partially porous surface.

The deformation may also be configured to at least partially enhance the surfing by temporarily reducing the fluid relief as the surfer surfs over the at least partially porous regions. The fluid relief is temporarily reduced by reducing porosity of the porous regions. In one embodiment, porosity is reduced by buckling of the slot edges and restricting or throttling of the corresponding apertures. A reduction in fluid relief increases the volume of fluid on the other surface which increases uplift and in turn pushes a rider away from the other surface.

Temporarily reducing fluid relief may at least partially reduce the rate of drainage of fluid drained from the other surfing surface. This reduction in drainage rate at least partially reduces energy usage of the surfing device by reducing the rate of projection of the projected energy required to enable the surfer to surf over the other surface at least partially via the projected energy.

In one embodiment, the other surface is modular and constructed of connected modules. Each module may comprise one or more of the following: at least a portion of the other surface; and at least one energy projecting outlet. The modules may further comprise structural members of the energy projecting structure configured for connection to form the structure. Each module may further comprise connecting means for connecting adjacent modules. The connecting means may be further configured for connecting its energy projecting outlets with the fluid projecting means. The connecting means may be further configured for secure assembly of the modules to construct the surfing device. The connecting means may be adapted, for example, for mechanical or chemical connection. Mechanical connection may comprise interlocking portions, fasteners such as crimps, ties, clips, or nut and bolts, cables, pins, sewing, threading, cavities supported in a supporting substrate, or any combination of these. Chemically connection may comprise heat bonding, ultrasonic welding or gluing or a combination of these. The connecting means may be detachable for disassembly and re-assembly of the surfing device. This detachable feature may be configured to modify the surfing device. The modification may comprise one or more of the following: layout and in particular the surface, or performance. The detachable feature may further be suitable for disassembling the surfing device, moving disassembled components to another location and reassembling the surfing device. The modules may further comprise one or more of the fluid relief and the floatation means.

The energy projecting outlets may be spaced substantially evenly. Due to the shape of the surface, effective spacing may vary for different regions of the virtual surfing surface. The variable nature of the effective spacing creates a resolution effect on the projected energy. This resolution effect alters the effective surface area of projection of the projected energy onto the virtual surfing surface. In one embodiment, it at least partially alters concentration of projected energy onto the virtual surfing surface.

The nozzles may be spaced, in longitudinal direction substantially aligned with the longitudinal length, at a distance ranging from approximately 50 to 300 millimeters. In one embodiment, the nozzles are spaced, in a direction transverse to the longitudinal direction, at a distance ranging from approximately 250 to 600 millimeters. The surfing device may comprise approximately 6 to 60 project nozzles per square-meter of the other surface. The nozzles may be substantially round in cross-section. In one embodiment, the nozzles have an effective diameter ranging from approximately 20 to 120 millimeters.

The fluid projecting nozzles may comprise a cover means. The cover means is configured to prevent unwanted particles or objects entering the nozzles. The cover means may also prevent parts of a person such as their eyes, fingers or toes from entering the nozzles. In one embodiment, the cover means comprises gauze. The gauze may have an aperture size ranging from approximately 10 to 1,000 square-millimeters. The gauze aperture size may comprise a variety of aperture shapes.

The energy projecting means may be configured to enable a person to surf upon the virtual surfing surface using an at least partially planar object. In one embodiment, the planar object further comprises at least one energy receiving region configured to receive the projected energy. The at least one energy receiving region may be adapted for a specific form of energy projected by the energy projecting means. In one embodiment, the at least one energy receiving region is at least partially contoured. In another embodiment, the at least one energy receiving region is adapted to absorb energy in the form of electromagnetic radiation. In this embodiment, the at least one energy receiving region at least partially comprises metallic or magnetic materials or both magnetic and metallic materials. The planar object may further comprise a data means configured at least for data storage. The data means may be further configured for data retrieval. In another embodiment, the data means is configured for real time operation. The planar object may further comprise an at least partially stiff underneath portion. In another embodiment, the planar object further comprises an at least partially soft upper portion. The planar object may comprise, for example, a surfboard or boogie board having one or more of the following: the at least one energy receiving region; the at least one contour; the data means; the at least partially stiff underneath portion; and the at least partially soft upper portion. In one embodiment of the present invention comprising energy projecting means in the form of fluid projecting means, the substantially planar object further comprises an at least substantially conventional surfboard or boogie board.

In one embodiment, the surfing device comprises surfing support means for supporting a person during the surfing. In one embodiment, the surfing support means comprises a tether means, for example a cable or rope, which at one end is fixed relative to the virtual surfing surface and at the other end is configured for holding by the person. The energy projecting means may be configured to project energy within a predetermined directional range for at least partially constant tensioning of the tether means during the surfing.

In another aspect of the present invention, there is provided a method of enabling surfing comprising the steps of: (a) providing least one energy projecting means for projecting energy, at least one energy recycling means for recycling at least some energy of the projected energy, and at least one corresponding energy projecting structure, the energy projecting structure being configured for supporting the energy projecting means to provide a plurality of energy projecting positions for projection of energy therefrom and the energy projecting means being configured to project energy from the plurality of energy projecting positions to provide, upon interaction of a surfer with the projected energy, a virtual surfing surface positioned, relative to each of the plurality of energy projecting positions, at a distance therefrom in a direction of the energy projection, the energy projecting structure also being configured for supporting the energy recycling means for projecting recycled energy from one or more recycled projection positions; and (b) arranging the energy projecting structure to support and position the energy projecting means and the energy recycling means for projecting corresponding energy from the respective plurality of energy projecting positions and the one or more recycled projection positions to enable the surfer to surf upon the virtual surfing surface at least partially via energy projected from both the energy projecting positions and the recycled projection positions.

In one embodiment, the method of enabling surfing further comprises the step of providing recycled projection positions that are additional to the plurality of energy projecting positions. This embodiment may further comprise the step of positioning the additional recycled projection positions remote from the one or more energy projecting positions. In another embodiment, the method of enabling surfing further comprises the step of providing other additional recycled projection positions comprising one or more of the plurality of energy projecting positions, or projection positions proximal to the one or more of the plurality of energy projecting positions. In another embodiment, the method of enabling surfing further comprises the step of providing the additional and other additional recycled projection positions. In yet another embodiment, the method of enabling surfing further comprises the step of arranging the energy recycling means to recycle static or dynamic fluid pressure, or both.

The method may further comprises the step of providing the one or more additional recycled projecting positions at a predetermined additional energy projecting region, the predetermined additional energy projecting region being proximal to a predetermined region of the virtual surfing surface. In one embodiment, the method further comprises the step of positioning the predetermined energy projecting region at or near a front region of the virtual surfing surface wherein the front region is a region where the recycled projection from the additional recycled projection positions has a greater velocity. In another embodiment, the method further comprises the step of projecting energy from the other additional recycled projection positions with a lower velocity proximal to the front region and a higher velocity the more removed from the front region.

In one embodiment, the method further comprises the step of projecting the projected energy to position the virtual surfing surface at a predetermined distance relative to each of the plurality of energy projecting positions.

In another embodiment, the method further comprises the step of projecting energy from the energy projecting means to enable the surfer to surf upon the virtual surfing surface at least partially via the projected energy.

In another embodiment, the present invention further comprises the step of arranging the energy projecting means and energy projecting structure to enable a person to surf at least substantially via the projected energy.

The step of surfing may further comprise the step of enabling interaction of the person, or more preferably the person's surfboard or boogie board, with the projected energy. In one embodiment, the method further comprises the step of arranging one or more of the energy projecting means and energy projecting structure to simulate an ocean wave. In this embodiment, the method may further comprise the step of arranging the surfer to surf at least essentially naturally upon the virtual surfing surface. In another embodiment, the at least essentially natural surfing is essentially equivalent to surfing on an ocean wave.

In one embodiment, the method may comprise the further step of providing the energy projecting positions proximal to the virtual surfing surface.

In another embodiment, the method may comprise the step of providing one or more energy projecting outlets. In one embodiment, the method of enabling surfing further comprises the step of providing one or more energy projecting outlets having statically or dynamically, or both, adjustable apertures.

The method may further comprise the step of arranging the energy projecting means or energy recycling means or both to project fluid. In this embodiment, the method may further comprise the step of providing energy projecting outlets in the form of nozzles. In another embodiment, the method comprises the step of arranging the energy projecting means or energy recycling means or both to project an alternative form of energy, for example, electromagnetic energy. In yet another embodiment, the method comprises the step of arranging the energy projecting means or energy recycling means or both to project a combination of one or more of these and suitable alternative non-specified forms of the energy One embodiment of the present invention further comprises the step of at least partially continuously projecting energy in the form of fluid. In one embodiment, this further step comprises providing energy projecting means or energy recycling means or both in the form of fluid projecting means. In one embodiment, the present invention further comprises the step of providing a fluid relief means for removing excess fluid from the surface. In this embodiment, the excess fluid is the fluid that interacts adversely with the surfing. The further step may comprise the step of arranging the fluid relief means to modify the surfing. This modification step may comprise the step of modifying the surfing by altering a level of difficulty of the surfing. The step of providing fluid relief means may further comprise the step of arranging the fluid relief means to alter, for example, one or more of at least the following characteristics of the surfing: drag, fluid projection angle, penetration of the projected fluid.

In one embodiment, the planar object comprises at least one fluid receiving region for direct receipt of the projected fluid, wherein the at least one fluid receiving region is configured to enable a surfer to surf upon the virtual surfing surface or over the actual surfing surface substantially via direct contact with the projected fluid. Preferably, the fluid receiving region is further configured to enable a surfer to surf upon the virtual surfing surface or over the actual surfing surface.

The fluid receiving region may be at least partially concave. In one embodiment, the at least partially planar object comprises a plurality of at least partially concave regions which may collectively comprise a waved surface. Fluid receiving regions of the at least partially concavely shaped and waved surface embodiments are shaped to at least partially enhance uplift provided by the projected fluid.

The at least one energy receiving region of the planar object may be adapted for a specific form of energy projected by the energy projecting means. The specific form of energy may comprise one or more forms of energy and any combination thereof. In one embodiment, the at least one energy receiving region comprises at least one contour. In another embodiment, the at least one energy receiving region is adapted for absorbing electromagnetic radiation. In this embodiment, the at least one energy receiving region at least partially comprises metallic or magnetic materials or both magnetic and metallic materials. The planar object may further comprise a data means configured at least for data storage. The data means may be further configured for data retrieval. In another embodiment, the data means is configured for real time operation. The planar object may further comprise an at least partially stiff underneath portion. In another embodiment, the planar object further comprises an at least partially soft upper portion. In yet another embodiment, the planar object comprises for example, a surfboard or boogie board having one or more of the following: the at least one energy receiving region; the at least one contour; the data means; the at least partially stiff underneath portion; and the at least partially soft upper portion. In another embodiment, the substantially planar object further comprises an at least substantially conventional surfboard or boogie board.

Any references in this specification to "surfing" is not limited to water surfing and may include water skiing and other types of surfing or skiing.

BRIEF DESCRIPTION OF THE DRAWINGS

The features, objects, and advantages of the present invention will become more apparent from the detailed description set forth below when taken in conjunction with the drawings, wherein.

DETAILED DESCRIPTION

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 1:
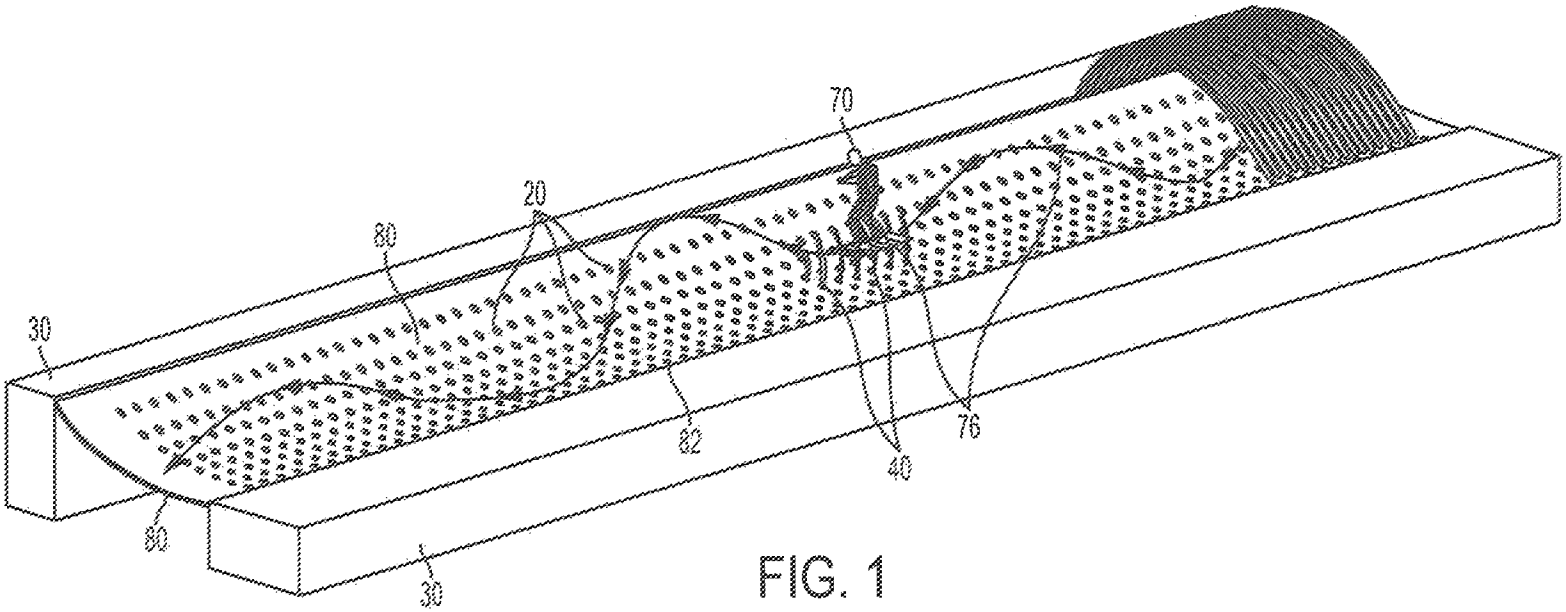
FIG. 1 is a perspective view of an embodiment of surfing device of the present invention without an energy recycling module.
Figure 2:
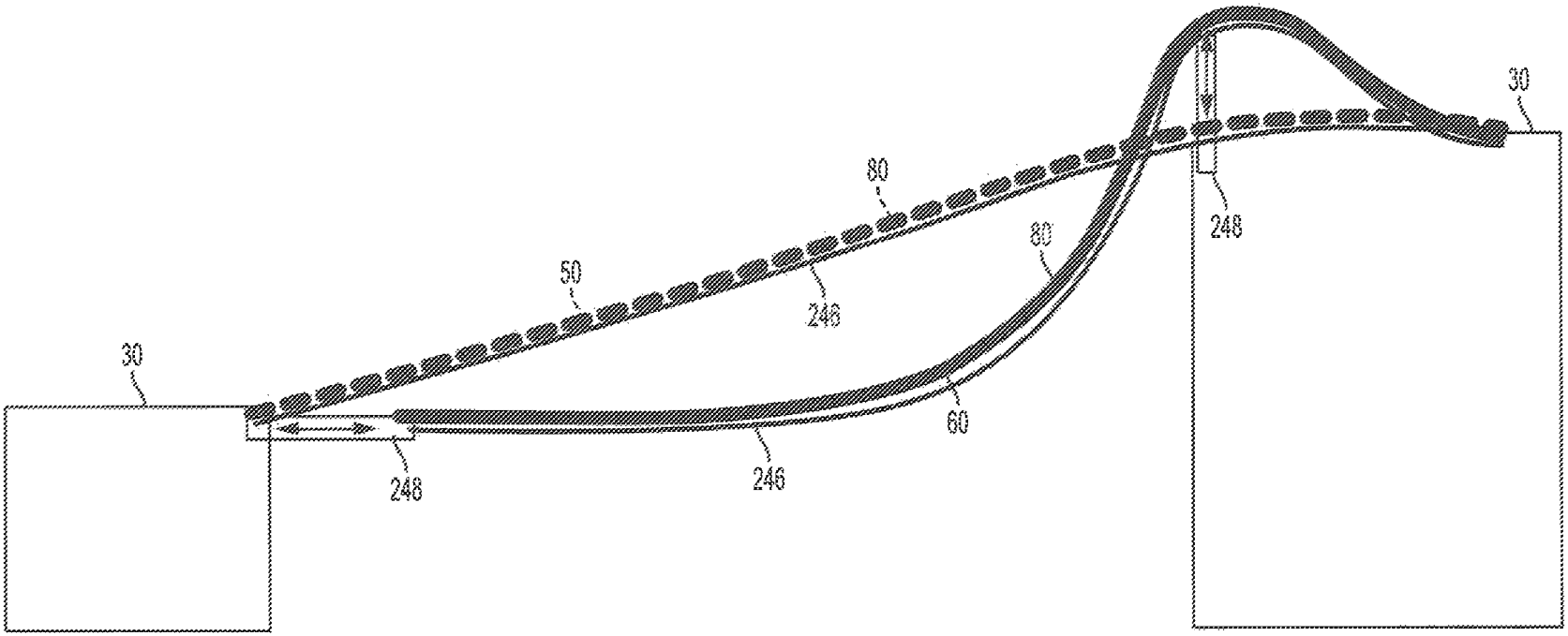
FIG. 2 is a cross sectional view of the device of FIGS. 1 and 1A.
Figure 4:
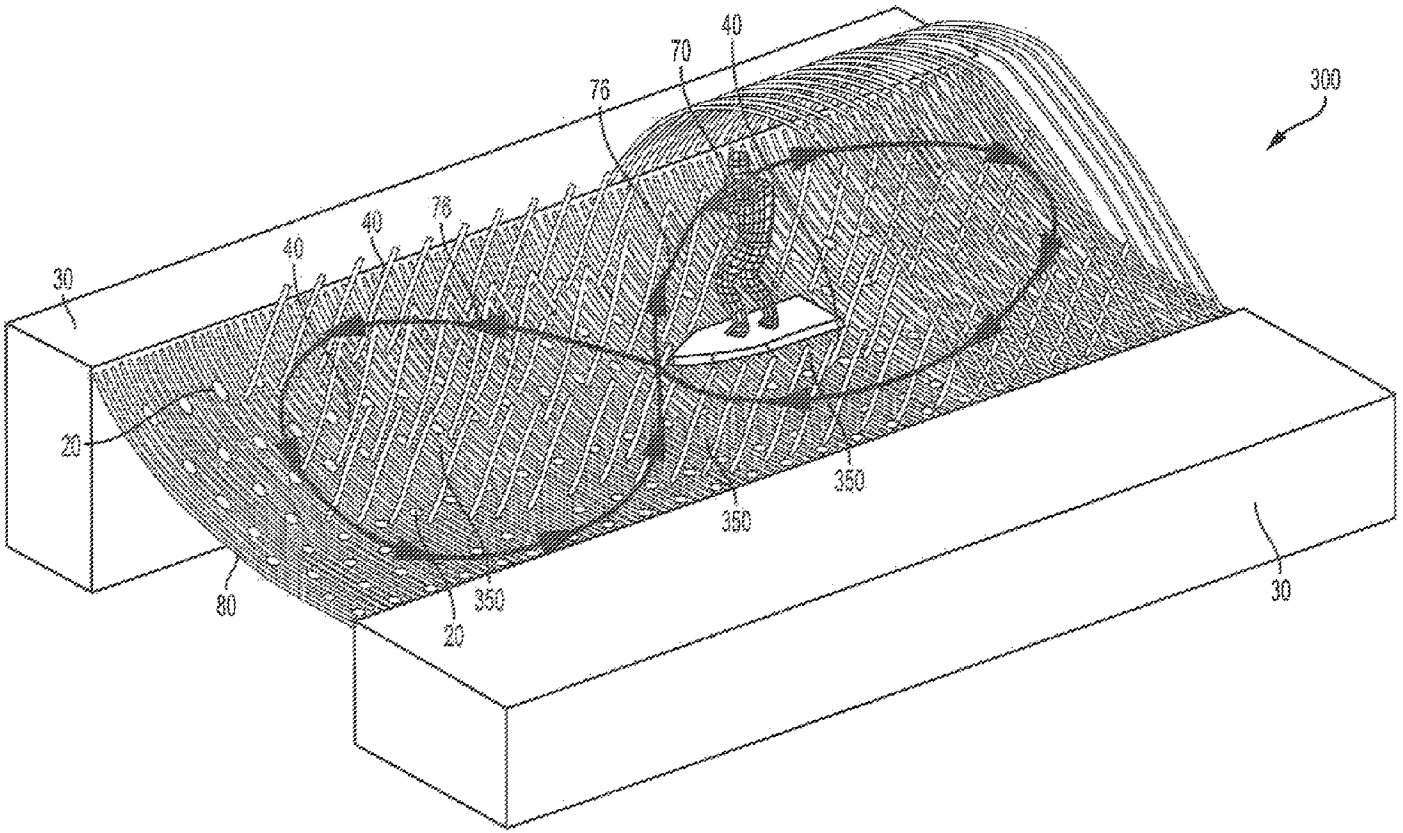
FIG. 4 is a perspective view of an embodiment of surfing device of the present invention without an energy recycling module.
Figure 11:
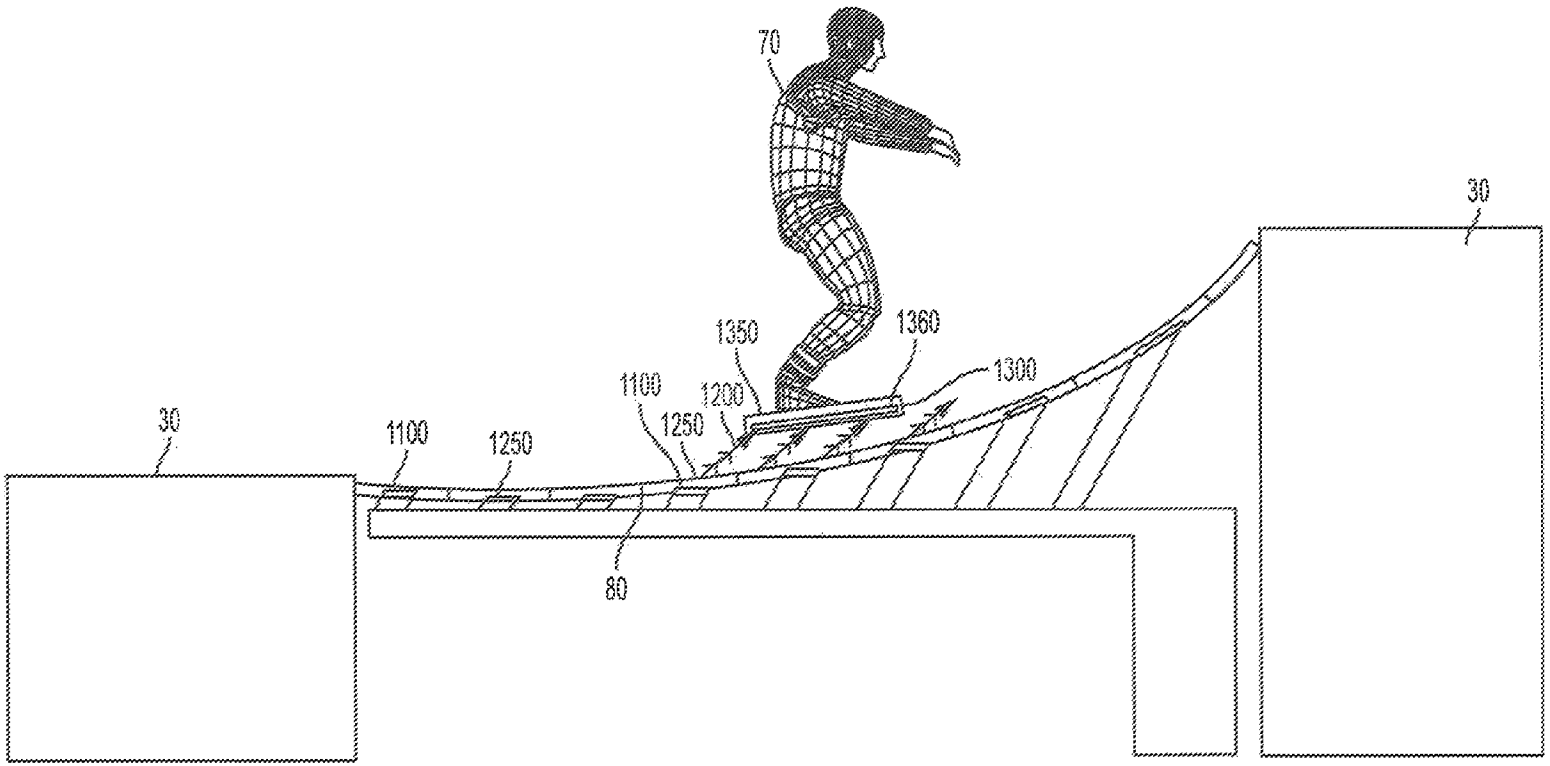
FIG. 11 is a cross sectional view of an embodiment of surfing device of the present invention without an energy recycling module.
Figure 12A:
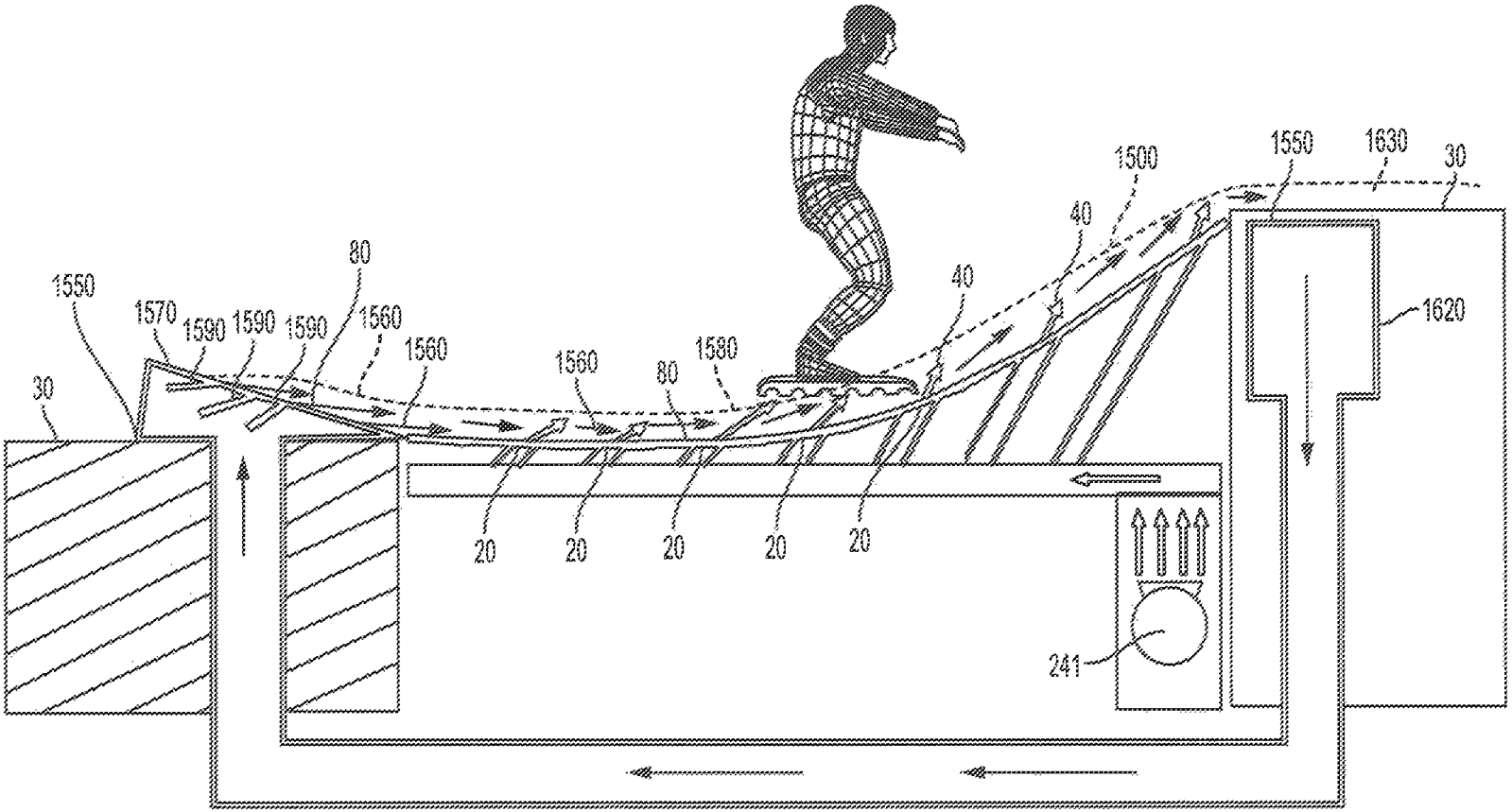
FIG. 12A is a cross sectional view of an embodiment of surfing device of the present invention comprising an embodiment of energy recycling module that recycles energy to a front region of the device
Figure 12B:
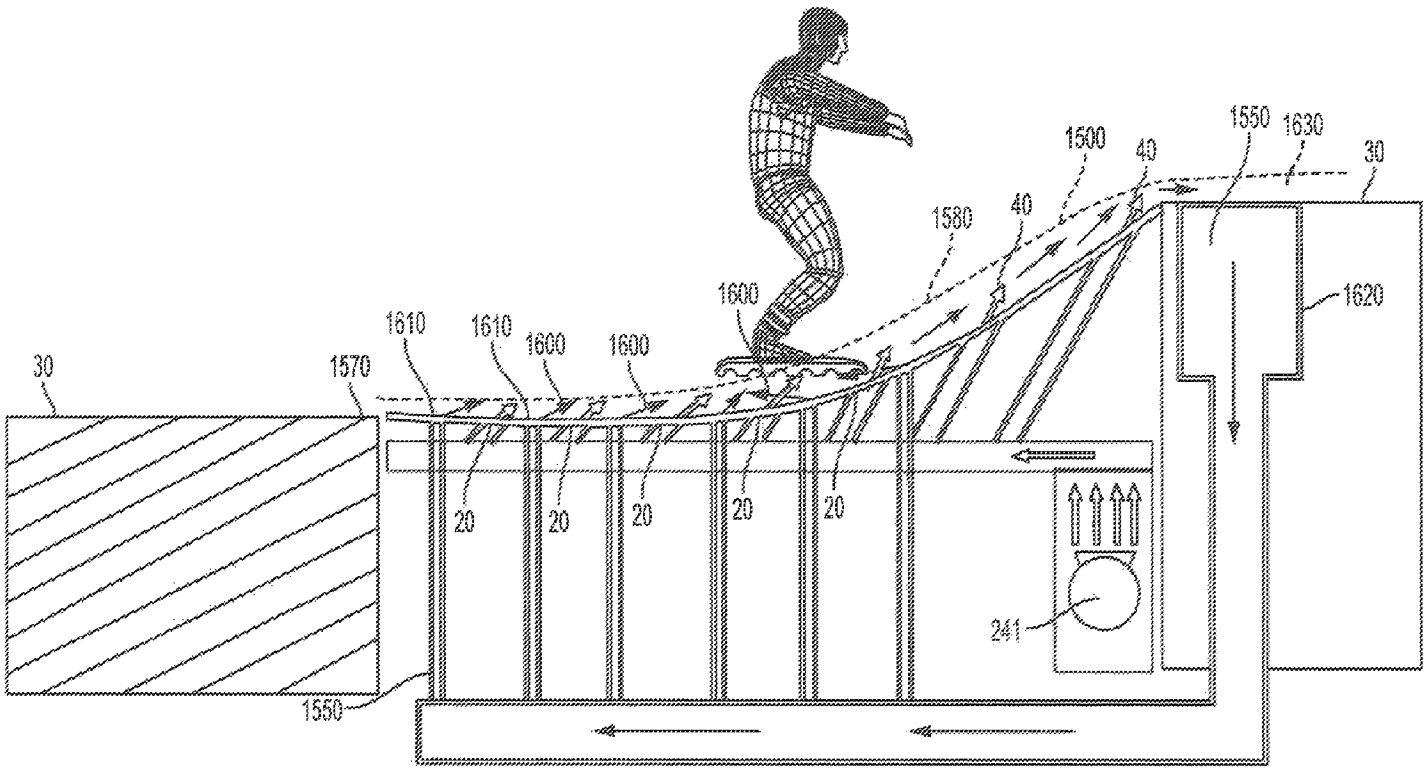
FIG. 12B is another cross sectional view of an embodiment of surfing device of the present invention comprising another embodiment of energy recycling module that recycles energy to other additional recycled projection positions of the present invention.
Figure 12C:
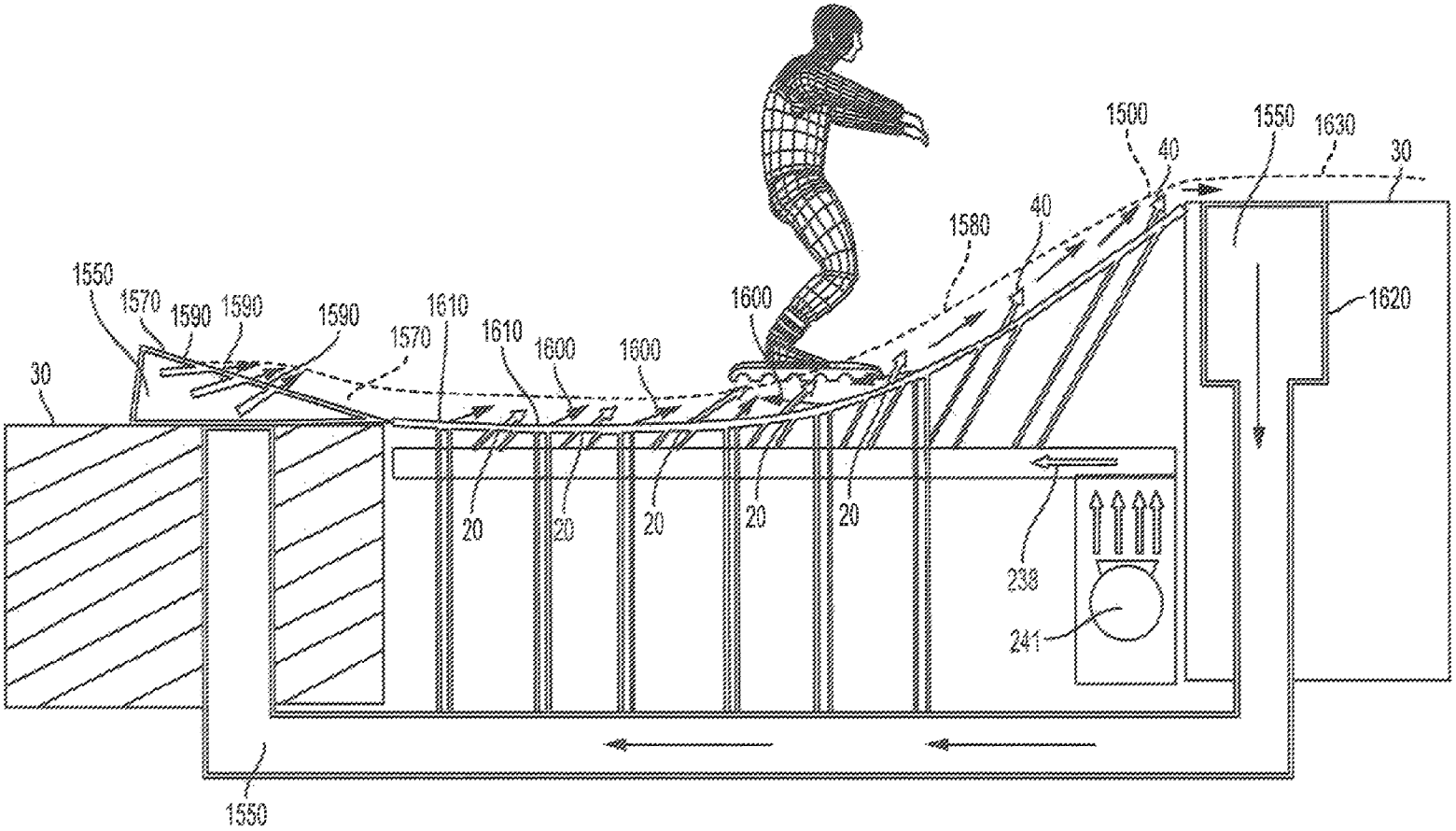
FIG. 12C is another cross sectional view of an embodiment of surfing device of the present invention comprising another embodiment of energy recycling module having energy recycling of both FIGS. 12A and 12B.
Figure 12D:
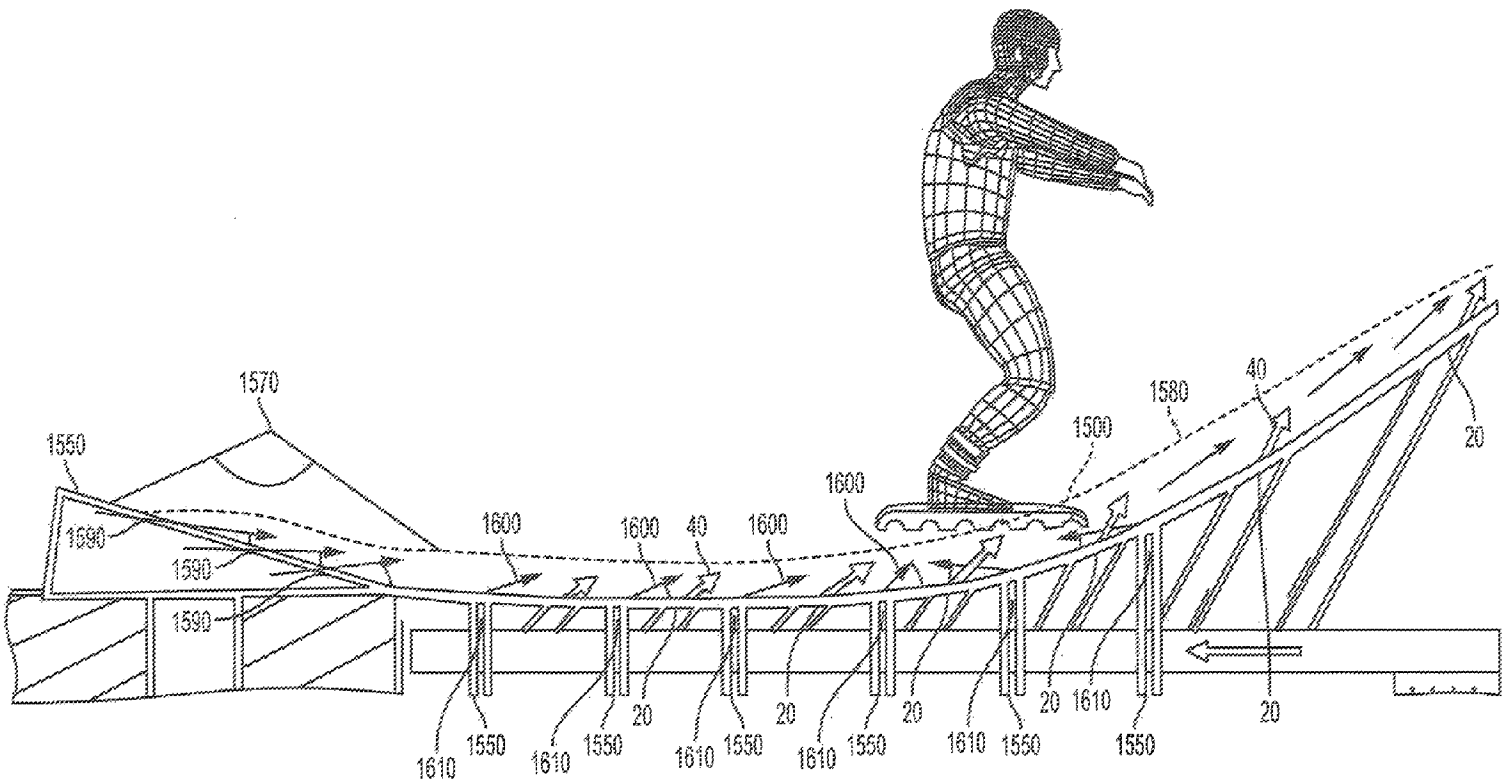
FIG. 12D illustrates a portion of the surfing device of FIG. 12C.
Figure 13:
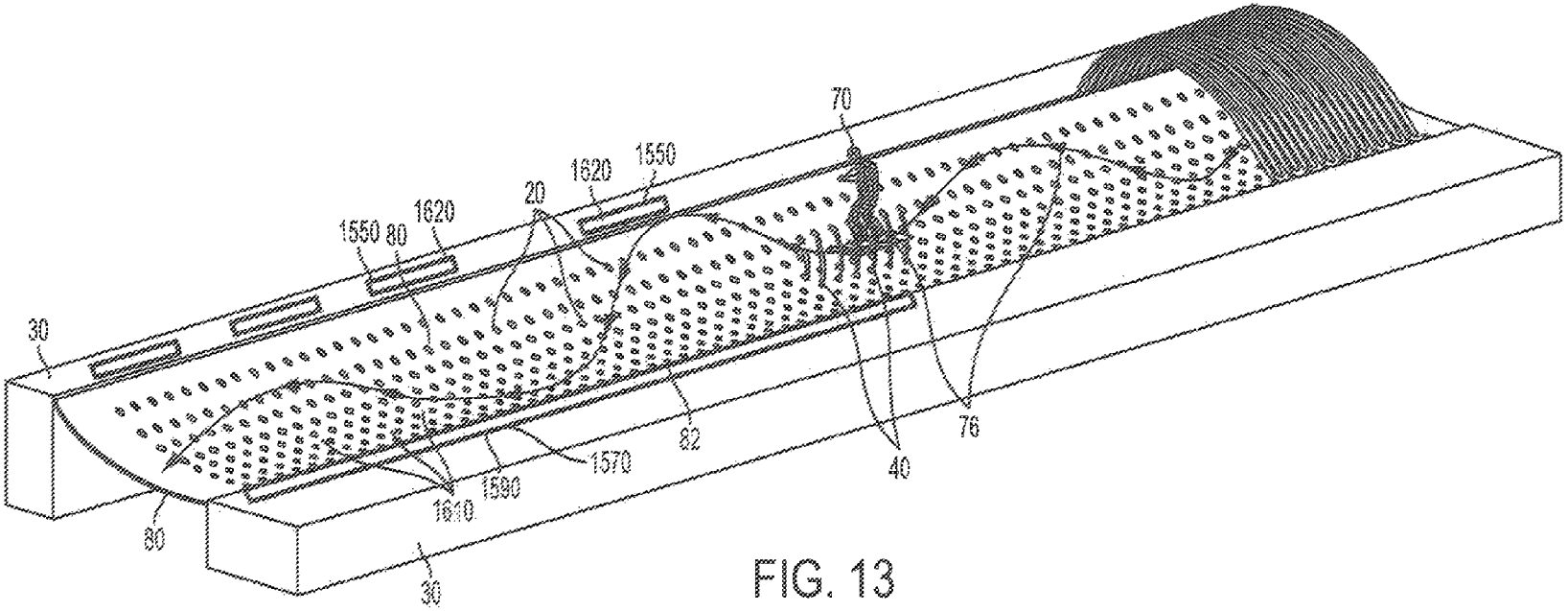
FIG. 13 is a perspective view of the device of FIG. 12C.

Referring to FIG. 1, an embodiment of surfing device of the present invention without an energy recycling means (an embodiment comprising an energy recycling means is described in FIG. 12-13). The surfing device comprises at least one energy projecting means in the form of nozzles 20 and at least one energy projecting structure 30 for supporting and positioning the nozzles 20. FIG. 2 shows an example of adjustment that the support structure 30 may be capable of between two extreme positions 50 and 60. The nozzles 20 are design to project energy in the form of fluid 40. The projected fluid 40 enables a person 70 to surf 76. The person 70 surfs via direct contact with the fluid 40 and essentially independent of another surface 80. As illustrated in FIGS. 1, 4 and 11, the person 70 surfs naturally over the surface 80 essentially equivalent to surfing naturally on an ocean wave. Surface 80 may be made of PVC. The nozzles 20 lie essentially flush with the surface 80.

Figure 1A:
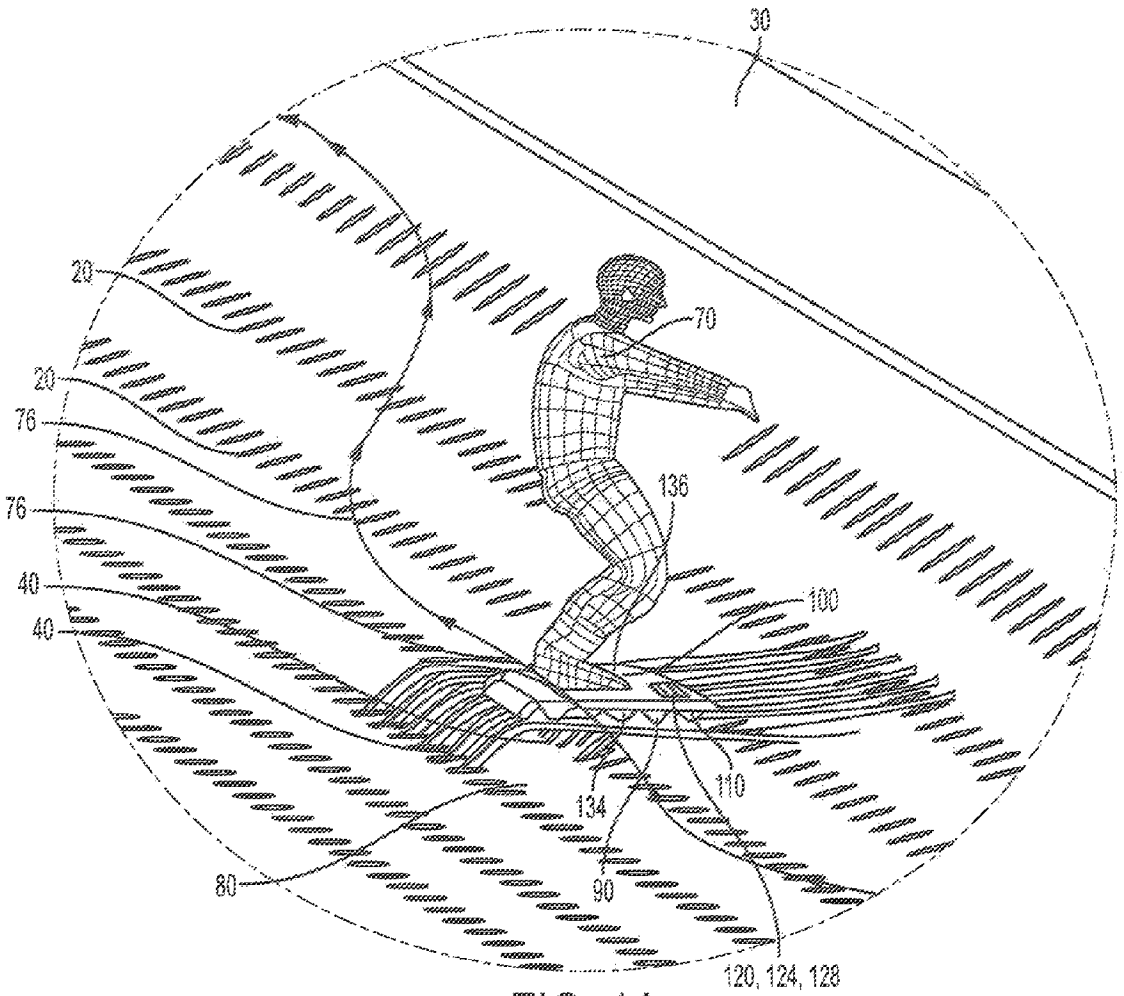
FIG. 1A is a perspective view of a portion of the device of FIG. 1.

The person 70 may surf 76 upon a simulated surfing surface 90 generated by fluid 40 as illustrated in FIG. 1A. Surfing 76 involves a planar object, for instance a surfboard 100. Interaction between the fluid 40 and an underneath surface 110 of the surfboard 100 enables the person 70 to surf 76 upon the surfing surface 90. The surfing surface 90 is positioned above the surface 80. The person 70 surfs 76 upon the surfing surface 90 and over the surface 80 essentially without contacting the surface 80. The person 70 therefore surfs 76 essentially free from any friction that would otherwise result from contact with the surface 80. In one embodiment where the surfing surface 90 coincides with the surface 80, the afore-mentioned friction would increase.

The surfboard 100 has an appearance that resembles a conventional surfboard; however, the surfboard 100 includes contours comprising a waved underneath surface 110. Also included in the surfboard 100 are data means in the form of a processor 120 and corresponding respective data receiving terminal 124 and emitting terminal 128. As may be readily appreciated by a person skilled in the art, emitting terminal 128 enables recorded data to be retrieved and analyzed. The processor 120 and terminals 124 and 128 of this particular embodiment is also designed for real time operation. The surfboard 100 also includes an at least partially stiff underneath portion 134 and a softened portion 136.

Figure 3:
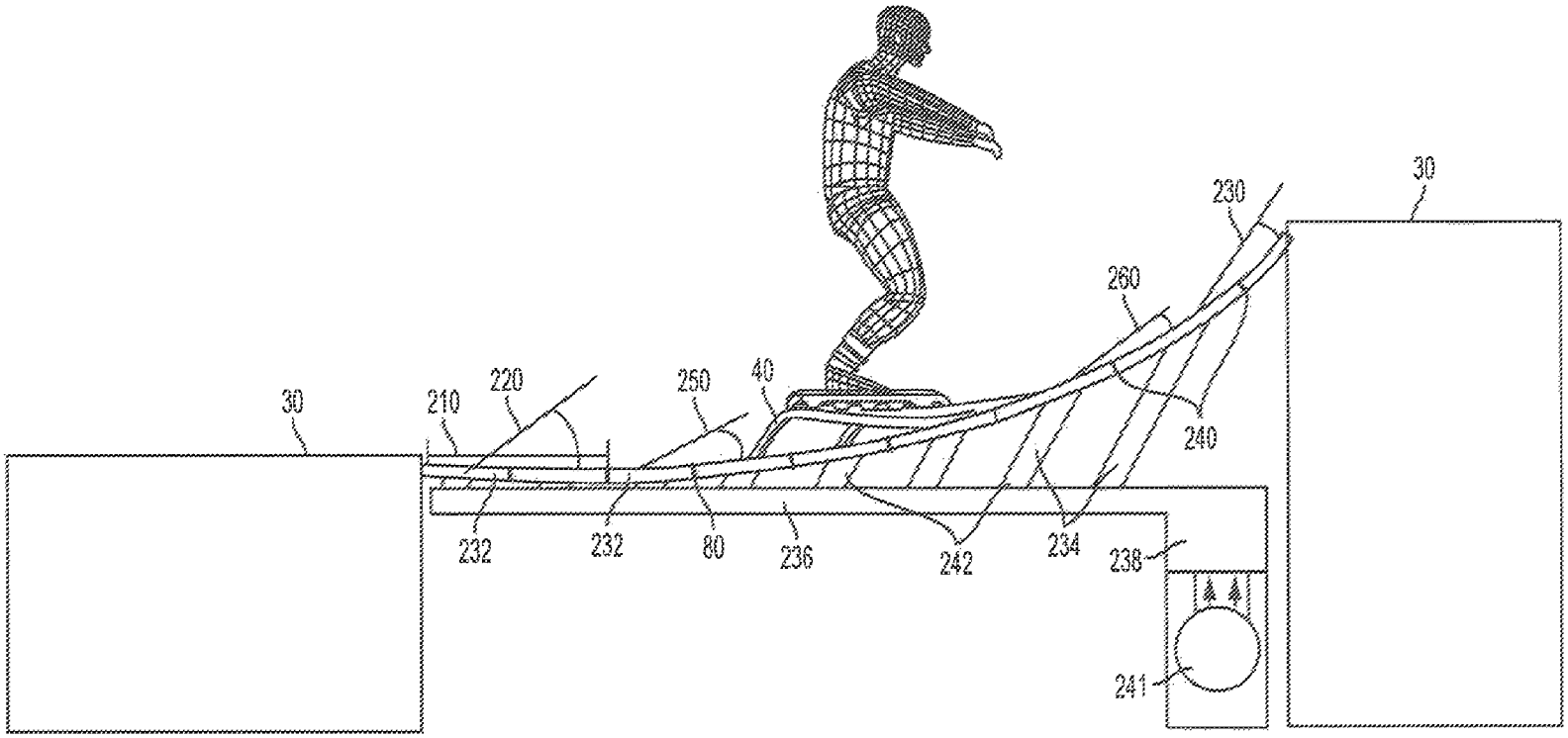
FIG. 3 is a cross sectional view of an embodiment of surfing device of the present invention without an energy recycling module.

As shown in FIG. 2, the surface 80 of the surfing device is supported on suspended cable or strap like supports 246 that are themselves supported by a frame 248. The modules 232 (as described in FIG. 3 below) are designed to readily facilitate assembly and disassembly for maintenance, and in relation to mobile versions of the surfing device which may be transported between different locations Referring to FIG. 3, the nozzles and support structure 30 are designed to simulate an ocean wave. The nozzles are positioned apart relative to each other to project fluid from energy projecting positions on the surface 80. The projected fluid directs energy outwardly of the surface 80 from a position which can either be on or below the surface 80. Fluid is projected with sufficient force or energy to enable a rider using a planar object, such as surfboard 100, to ride substantially free of any frictional forces that would otherwise occur between the surfboard 100 and the surface 80. The surface 80 is modular and constructed of connected modules 232. Modules 232 have nozzle housings 234 for receipt and housing of nozzles. The surfing device includes an energy projecting structure in the form of structure 236, which is designed for projecting the fluid 40. Each module 232 may contain as few as one nozzle 20 and one means for connecting another module. The structure 236 includes structural members 238 which connect to form structure 236.

Each module 232 includes connecting means 240, for example, nuts and bolts or crimps, ties, and clips, as well as other types of fasteners for mechanical connection, and fittings 242. The connecting means may also additionally or alternately comprise chemical connections, for example, heat bonding, ultrasonic welding or gluing or a combination of these. Mechanical connections may also include, for example, interlocking portions for connecting modules 232, cables and a supporting substrate providing a receiving cavity or other receiving feature. The fitting 242 is designed for connecting nozzles 20 with the fluid projecting structure 236. The fluid projecting structure 236 includes an energy projecting means comprising a pump 241 that pumps fluid 40 to the nozzles 20. The fitting 242 may be integrated into the modules 232, or alternatively is a separate connected component, for example, a sealed coupling.

Fluid 40 is projected at an angle ranging from approximately 10 to approximately 35 degrees relative to a tangential plane which is tangential to the surface 80, and amount values ranging from approximately 1,470.9975 Pa to approximately 4,903.325 Pa. However, the fluid 40 is mostly projected generally uniformly both in terms of the angle and force of projection. The surfing device, however, is designed so that it can include segments (for example, segment 210) that project fluid 40 at angles and forces generally different to those of other segments of the device. This variation enables the device to more closely simulate different surfing conditions at different points on a natural ocean wave. The respective range of projection angles described above may be represented by lines 220, 230, 250, and 260 of FIG. 3.

Again referring to FIG. 3, lines 250 and 260 represent a range of fluid projection angles and represent values of approximately 5 and 25 degrees relative to the aforementioned tangential plane. Referring to FIG. 4, this range of angles is typically more suited to continuous fluid projection of surfing device 300. The surfing device 300 includes, in addition to features of the surfing device noted above, a fluid relief means comprising fluid relief components 350. The fluid relief components 350 are designed for removing excess fluid from the surface 80. Excess fluid is any fluid that interacts adversely with surfing 76. The fluid relief components 350 are also designed to modify surfing 76. This modification is achieved by altering the level of difficulty of the surfing 76. However, the fluid relief components 350 are also designed to alter one or more of the following characteristics of the surfing 76: drag; fluid projection angle; and penetration of the projected fluid.

Figure 5A:
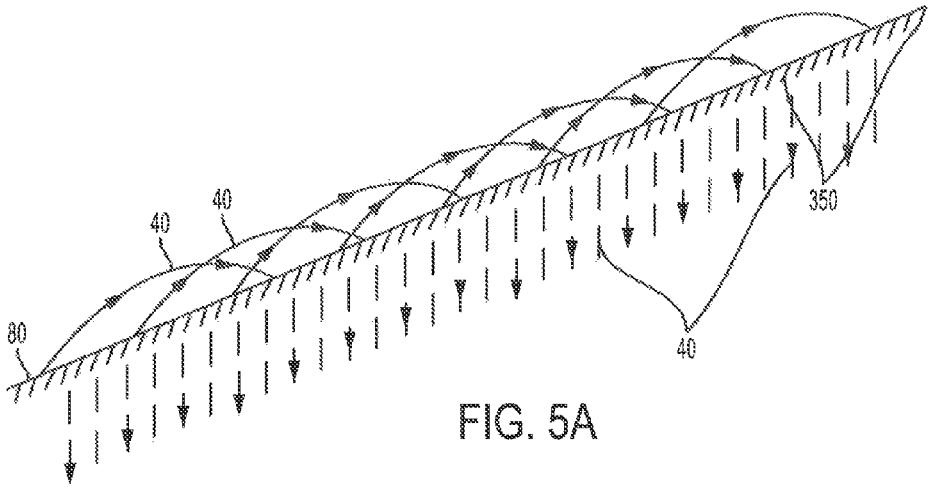
FIG. 5A is a cross sectional diagrammatic view of the surfing device of FIG. 4 showing an example of drainage of the present invention.
Figure 5B:
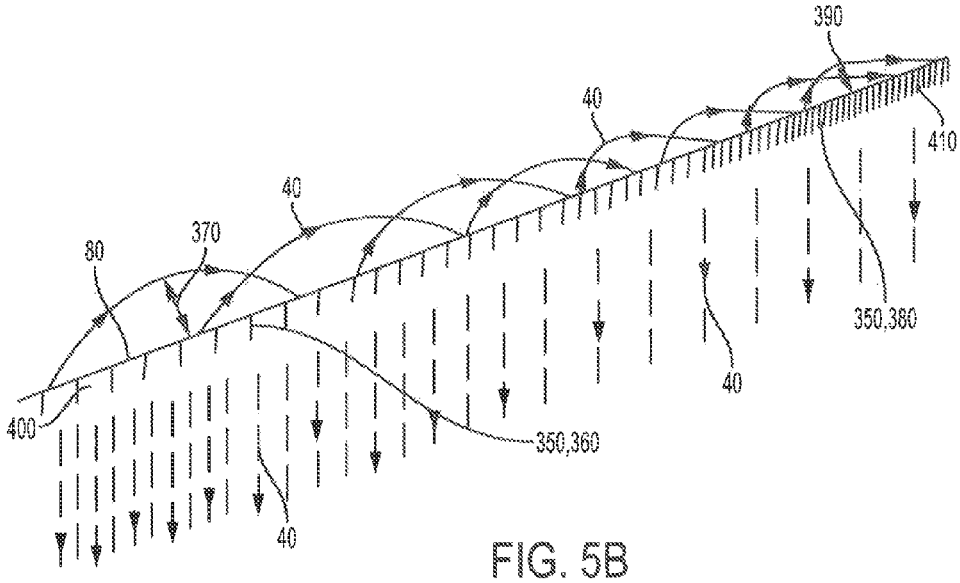
FIG. 5B is a cross sectional diagrammatic view of the surfing device of FIG. 4 showing another example of drainage of the present invention.

The fluid relief components 350 may be adjustable, both statically and dynamically. Static adjustment includes adjustment performed when the surfing device 300 is temporarily out of operational. Contrastingly, dynamic adjustment includes adjustment that is performed during surfing 76. The dynamic adjustment may be automated. FIGS. 5A-5B illustrate this adjustment and the corresponding effects schematically. Extremes of adjustment and the corresponding effects are represented, at the lower extreme by reference numerals 360 and 370, and the upper extreme by reference numerals 380 and 390.

Fluid relief of the surfing device 300 may be independently adjustable at different positions of the surface 80; this enables fluid relief to be set at different values at different positions. The adjustment is effectuated by varying a restriction to the flow of fluid through the fluid relief components 350. Referring to FIG. 5B, examples of extremes of this restriction are represented by reference numerals 400 and 410. Relative to the surfing device 300, a decrease or increase in fluid relief respectively increases or decreases drag associated with surfing 76. The fluid relief components 350 are also adjusted to simulate forces of an ocean wave and enhance stability by controlling drag.

Adjustment of the fluid relief of the surfing device 300 is also designed to change the angle of projection of fluid. By reducing or increasing fluid relief, the fluid projection angle is respectively decreased or increased. This change of fluid projection angle is at a distance from the surface 80. Relative to the surfing device 300, reduced fluid relief bends projected fluid toward a more acute angle relative to the surface 80. This bending is similar to, in relation to an ocean wave, more uplift. It is currently understood that this similarity is due to a lowering of the person 70 toward the nozzles 20. The fluid relief adjustment described above in relation to the surfing device 300 is also designed to maintain energy transfer of the projected fluid while reducing a distance the energy is transferred from the surface 80. Fluid relief of the surfing device 300 is designed to relieve fluid within a range from approximately 100% to approximately 50% of the projected fluid. It may, for example, comprise at least one or more of the following: suction or a vacuum; gravity; or centrifugal force.

Figure 7:
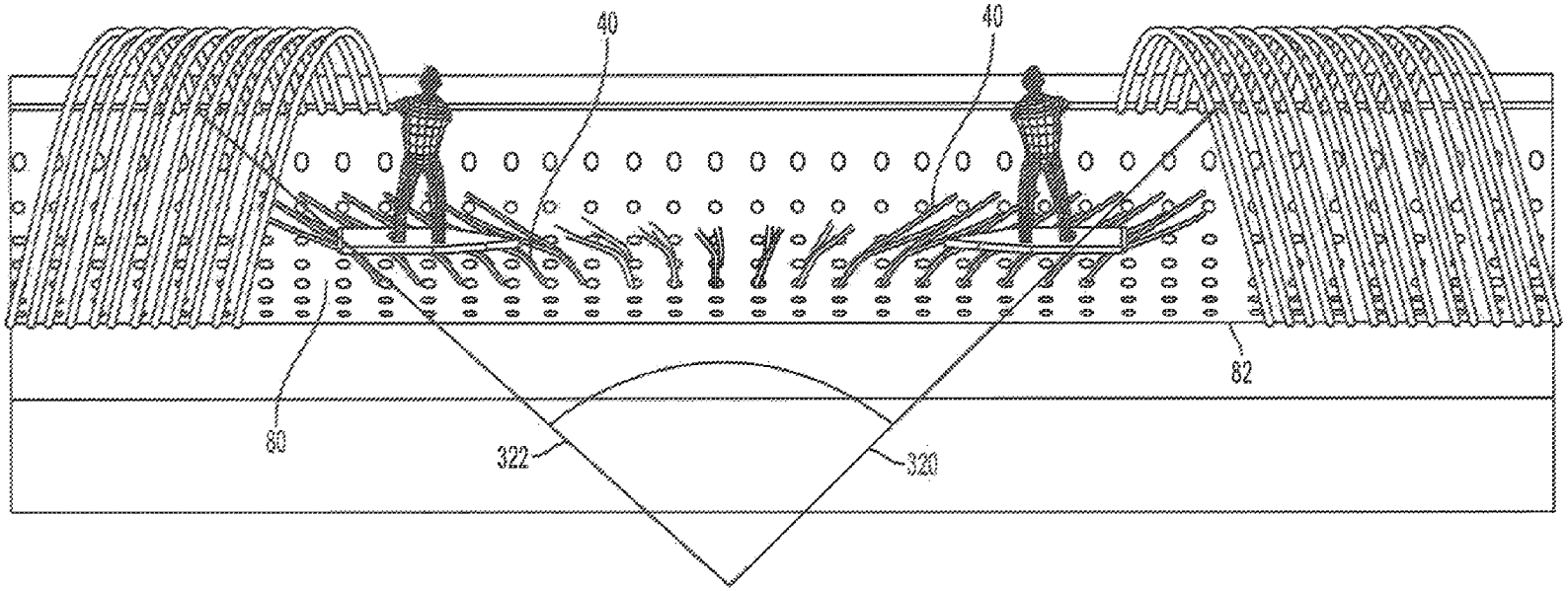
FIG. 7 is a front perspective view of the surfing device of FIGS. 1 and 4.

As shown in FIG. 7, fluid 40 is projected at a range of angles between approximately 45 and 135 degrees relative to a front edge 82 of the surface 80. These angles are represented by lines 320 and 322 respectively. This second group of projection angles further enables the ride to more closely simulate real wave effects. Real wave effects alter the dynamics of surfing. The surfing device is designed to simulate these effects, for example, making it easier or more difficult for a surfer to longitudinally traverse the surfing device. This adjustment of the level of difficulty is, for example, made by increasing or decreasing drag of the surfboard. Real wave effects are also enhanced by dynamic adjustment of both groups of projection angles described above so that the angles can be adjusted while the ride is operating. The surfing device may also have the capability of static adjustment of both groups of projection angles, i.e., adjusting the angles of projection when the device is not in use. The fluid projection is also described in U.S. patent application Ser. No. 13/997,012 which is hereby incorporated by reference.

Figure 6:
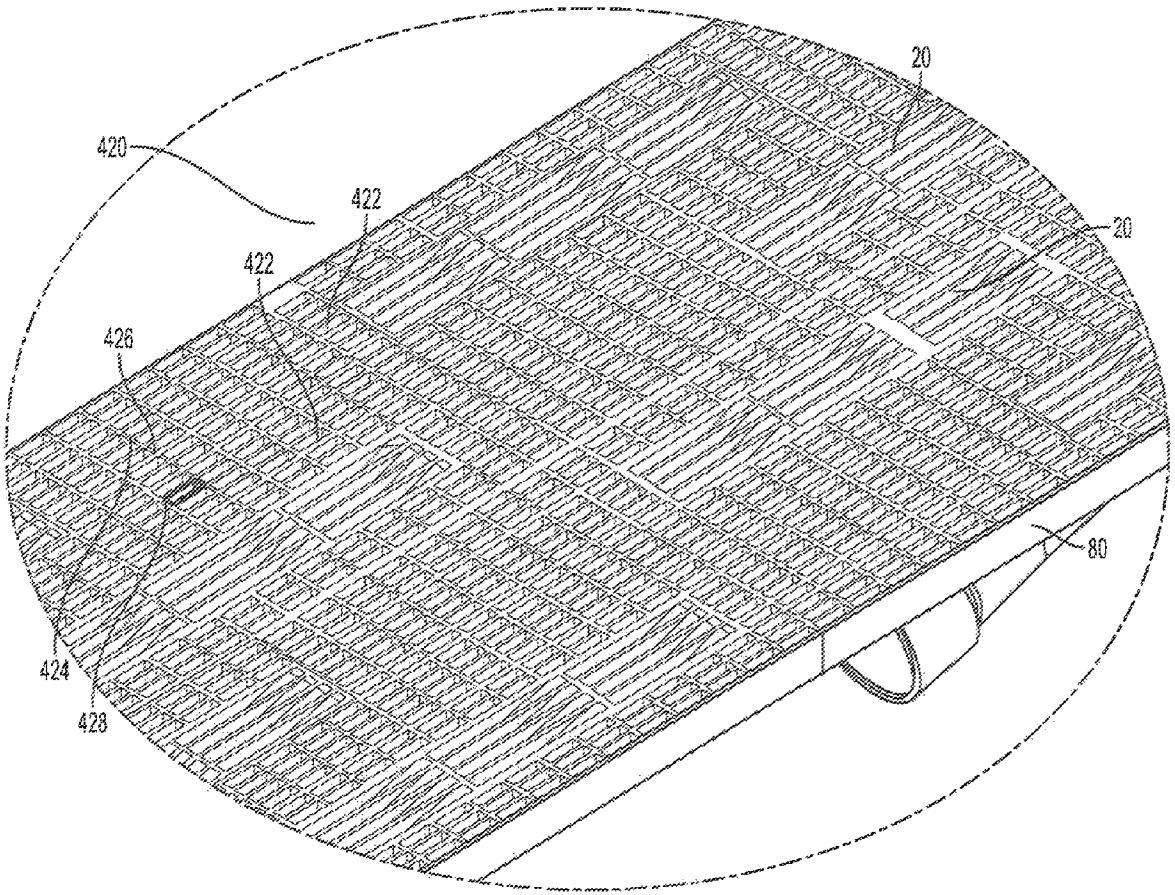
FIG. 6 is a perspective view of one embodiment of another surface of the surfing device of FIG. 4.

FIG. 6 illustrates an embodiment of another surface of the present invention that is at least partially porous to facilitate drainage, which takes the form of slotted or gauzed PVC 420. The slotted PVC 420 has a fluid relief or drainage ratio which corresponds to the ratio of surface area of the surface that is fluid permeable relative to the remainder of the surface area of the surface that is not fluid permeable. With respect to the slotted PVC 420, its fluid relief ratio is approximately 0.52 square-meter per square-meter. Consistent with the corresponding ratio calculation in relation to the present invention, this ratio is calculated from the ratio of the surface area of surface 80 that is fluid permeable relative to the remainder of the surface area of surface 80. Slots 422 of the slotted PVC 420 are formed by two corresponding pairs of oppositely positioned walls 424 and 426 that collectively define rectangular shaped apertures 428. One pair of the oppositely positioned walls 424 are spaced from each other ranging from approximately 3 to 15 millimeters, and the other pair 426 from approximately 15 to 50 millimeters.

Figure 6A:
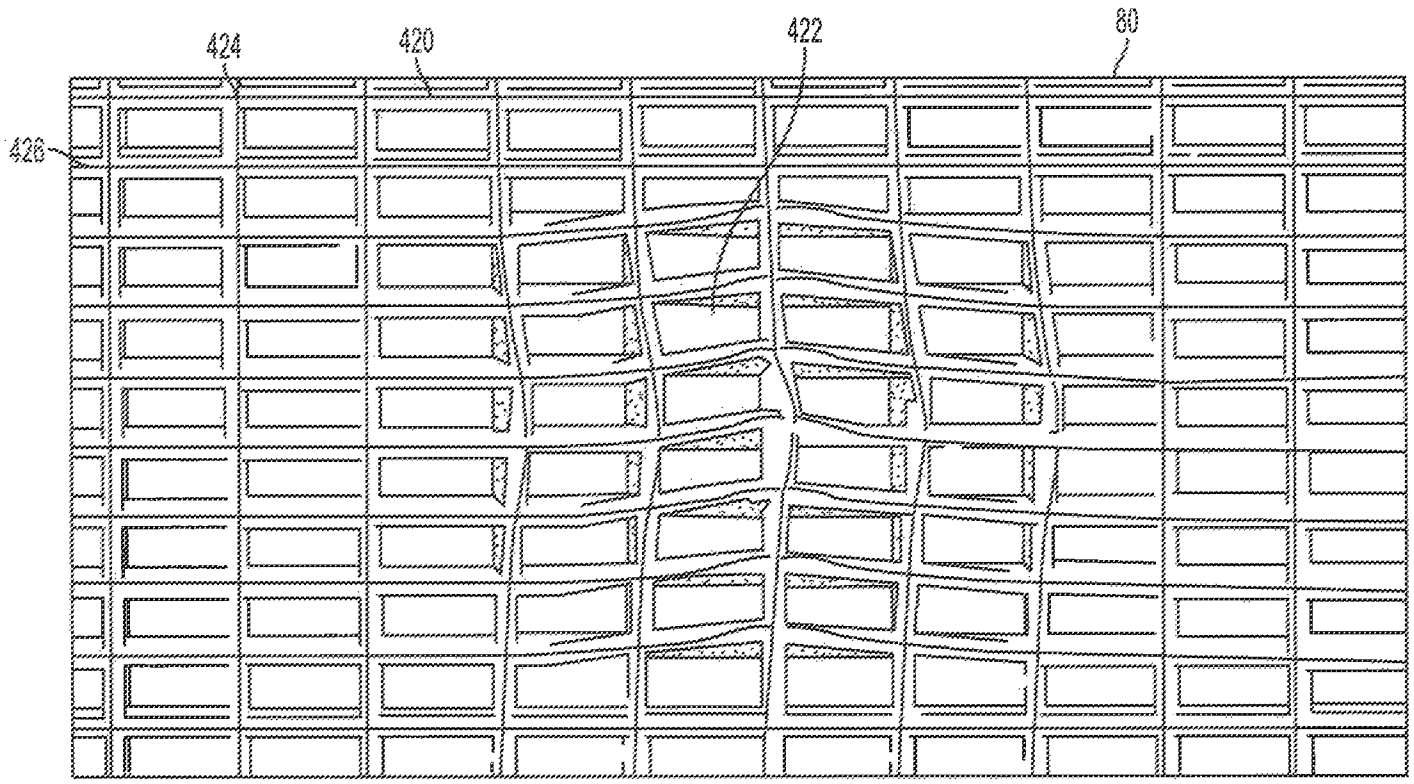
FIG. 6A is a schematic view of one embodiment of another surface of the surfing device of FIG. 4.
Figure 6B:
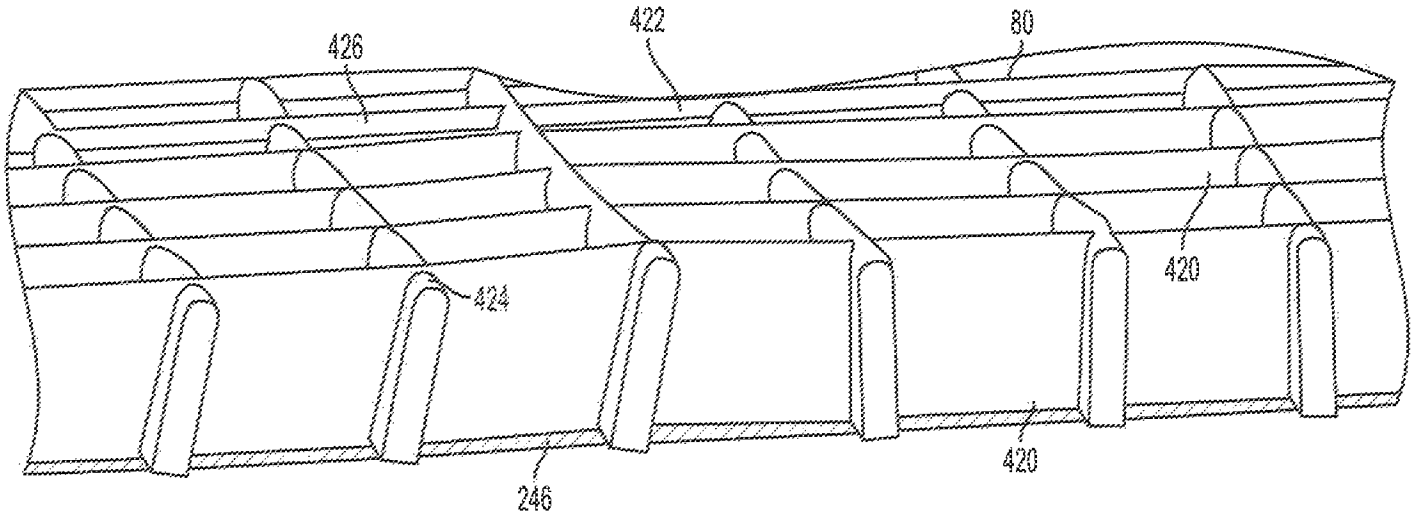
FIG. 6B is a perspective view of the surface of FIG. 6A.

Referring to FIGS. 6A and 6B, the partially porous surface of the slotted PVC 420 is designed to deform upon impact of a fallen rider to absorb the rider's energy and enhance ride safety. The walls 424 and 426 of the slotted PVC 420 deform by buckling. They are designed to essentially buckle instantaneously upon impact to provide a soft feeling for a fallen rider. The slotted PVC 420 is approximately 50 millimeters thick. As such, although the walls 424 and 426 of slots 422 buckle quickly, they are capable of absorbing most of the energy generated during a rider's fall. However, energy absorption can also be adjusted by using different materials, material thicknesses, densities, or a combination of one or more of these.

Figure 6C:
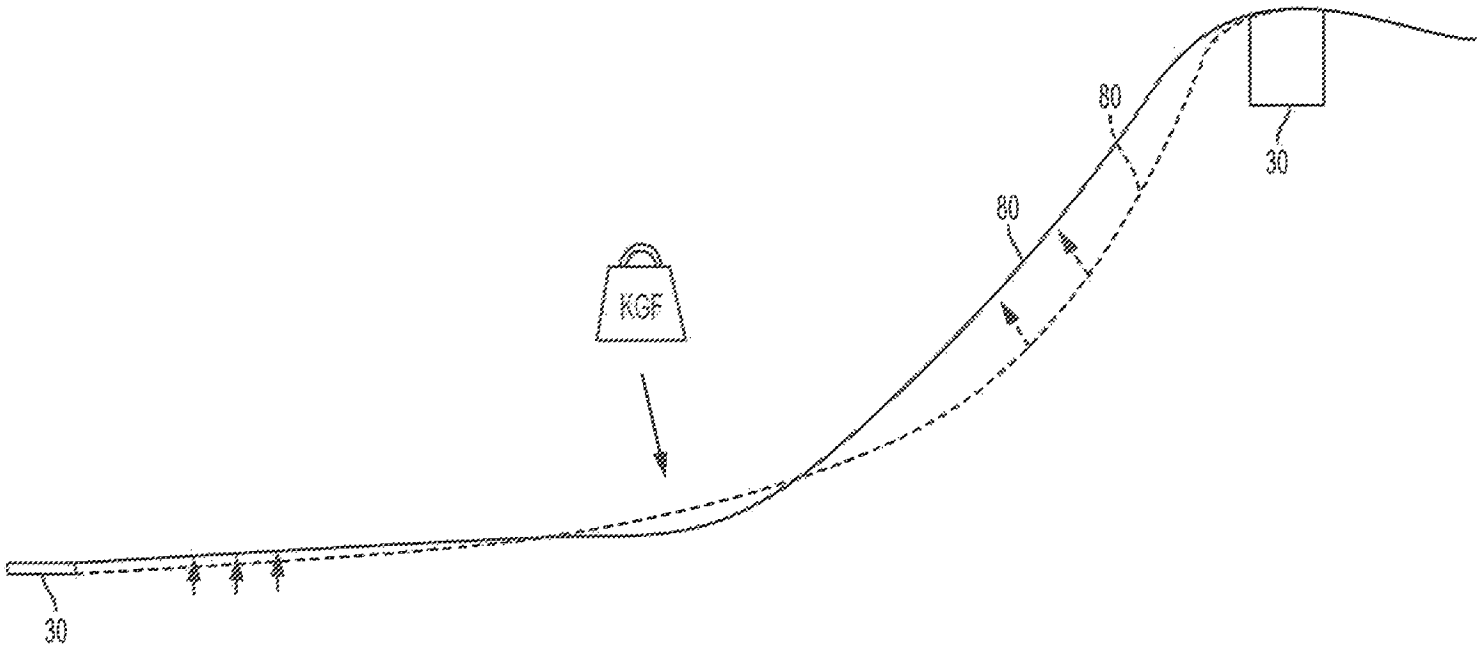
FIG. 6C is a schematic side view of the surface of FIGS. 6A and 6B.
Figure 6D:
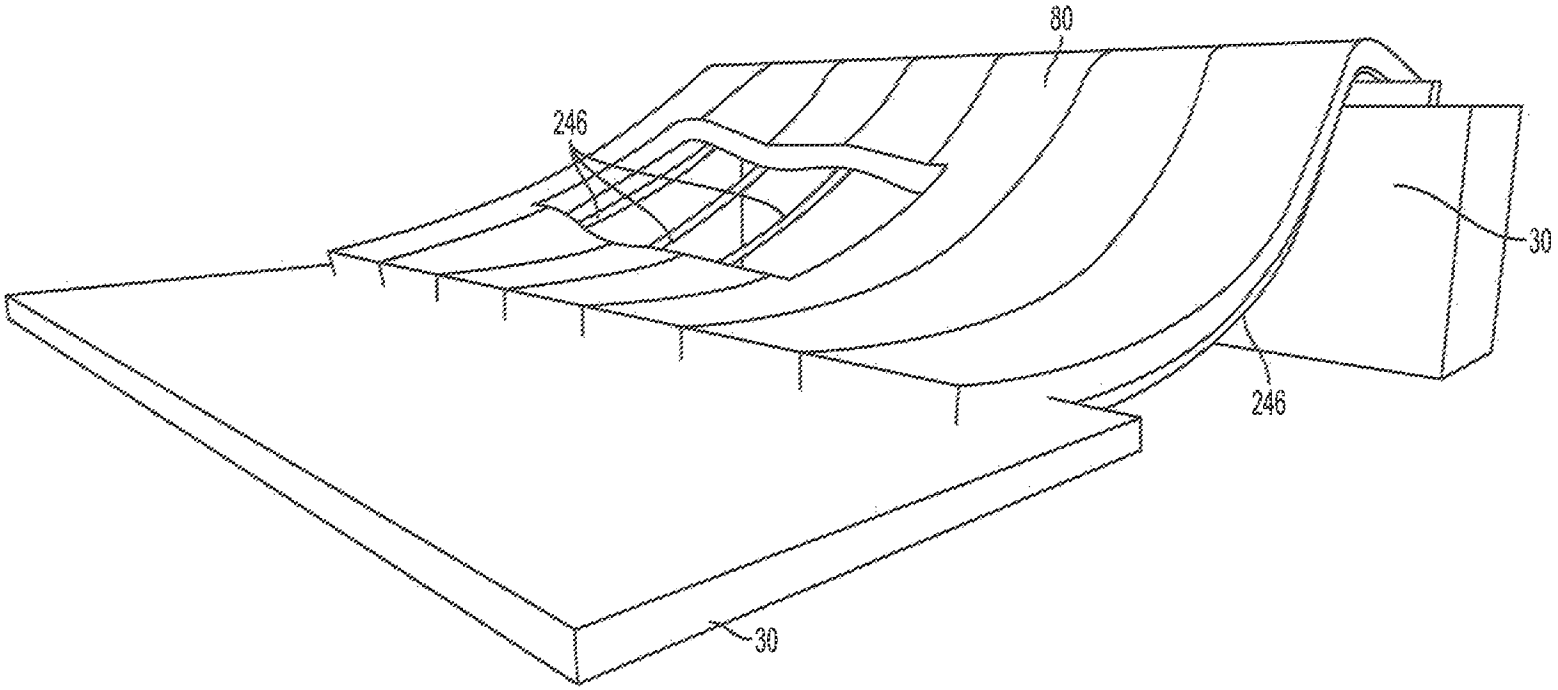
FIG. 6D is a schematic perspective view showing supporting cables of the surfing device of FIG. 6A.

The cables or straps 246 also absorb a fallen rider's impact. FIG. 6D shows the cables 246 looping under the surface 80. Referring to FIG. 6C, the cables 246 are slack enough, in the event of a rider falling onto the surface 80, to at least partially move away from the rider proximal their point of impact and absorb some of the impact. This away movement also results in corresponding movement of the cables or straps 246 on either side of the rider and at least partial lifting of surface 80. This lifting also contributes to impact absorption by lifting part of the weight of surface 80. The buckling described above also enhances surfing by temporarily reducing fluid relief as a surfer surfs over the slotted PVC 420. PVC 420 porosity is reduced by the buckling of walls 424 and 426, and corresponding restriction or throttling of the corresponding apertures 428. A reduction in fluid relief increases the volume of fluid on the surface 80 which in turn pushes the surfer away from the surface 80. This away movement is beneficial to the surfer as it increases uplift.

The reduction in fluid relief reduces the rate of drainage of fluid drained from the surface 80. This reduction in drainage rate reduces energy usage of the ride by reducing the rate of projection of fluid 40 required to enable the surfer to surf over the slotted PVC 420 without making any significant contact with the slotted PVC 420.

Surface 80 of surfing devices of FIGS. 1 and 4 are elongate. These surfing devices are therefore suitable for surfing along a longitudinal length of the elongate surface 80. However, as shown in FIG. 4, a person may surf within a relatively confined region. Surface 80 is therefore not necessarily required to be elongate.

Figure 8:
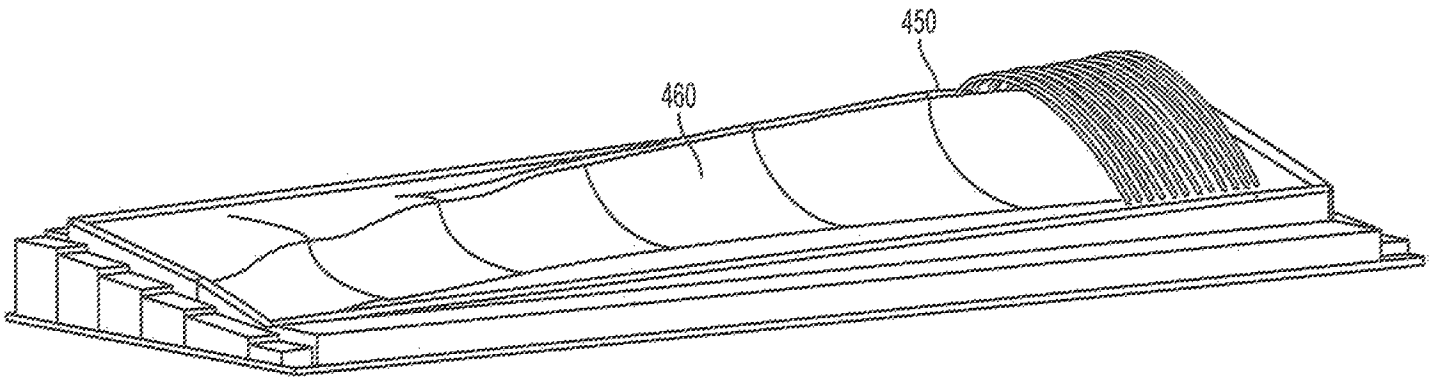
FIG. 8 is a perspective view of an embodiment of surfing device of the present invention without an energy recycling module.

FIG. 8 shows a surfing device 450 having a surfing surface 460 shaped to simulate the shape of an ocean wave. Surfing device 450 may comprise features of the surfing device described in FIG. 1 or 4.

Additional adjustable features of surfing devices include: the rate of projection of fluid 40; the angle of projection of fluid 40 (as described above); and the shape of the surface 80. These features are adjustable either statically or dynamically or both statically and dynamically. They are also independently adjustable relative to the other adjustable features and also relative to position of the surface 80. This enables different values to be set at any given time at different positions. The static and dynamic adjustments correspond to static and dynamic fluid relief adjustments described above. It may also include automatic adjustment control corresponding to manual and/or automatic fluid relief adjustment described above.

Figure 9:
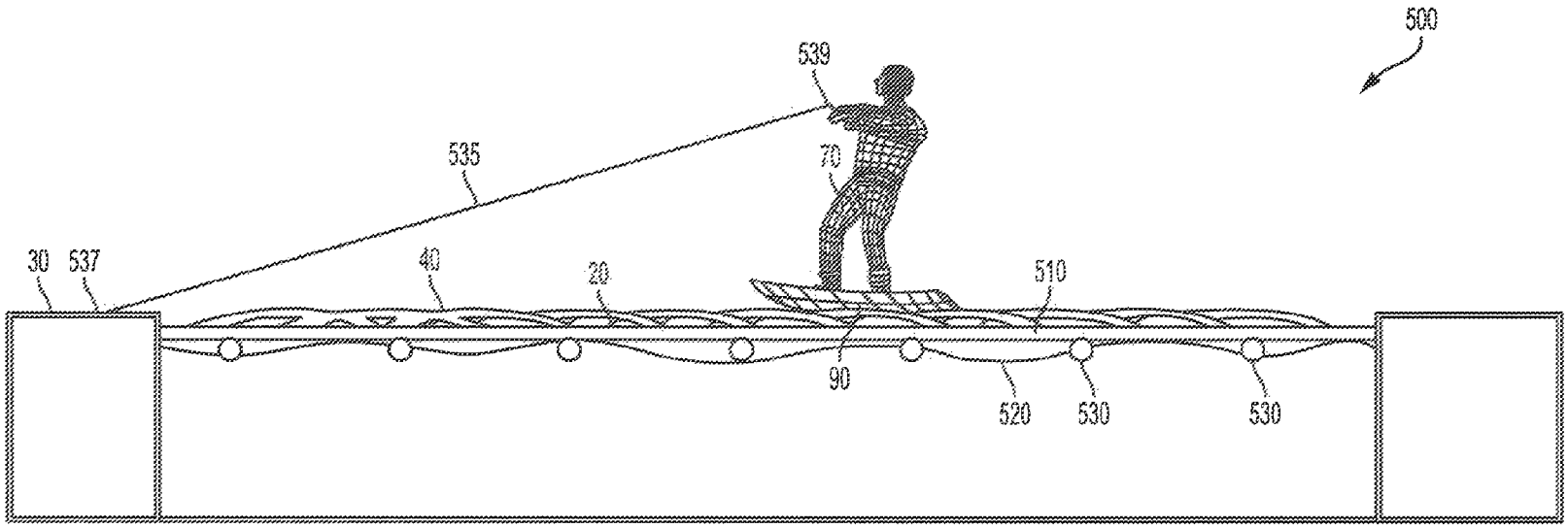
FIG. 9 is a cross sectional view of an embodiment of surfing device of the present invention without an energy recycling module.

FIG. 9 illustrates another embodiment of surfing device 500 of the present invention without an energy recycling means (an embodiment comprising an energy recycling means is described in FIG. 12-13). Surfing device 500 includes a horizontal and flat surface 510. Surface 510 is on top of or just beneath a body of fluid 520, or up to approximately 400 millimeters below an upper surface of the body of fluid 520. The surfing device 500 also includes surfboard 90.

The surfing device 500 includes at least one floatation means, such as floats 530. The floats 530 are connected to the surface 510 and designed for being supported by the fluid 520. A surfer 70 surfs 76 over the surface 510 of the surfing device 500 without making significant contact with the surface 510. The surfer 70 therefore surfs over the surface 510 essentially free from friction that would otherwise result from contact with the surface 510.

The surfer 70 surfs naturally over the surface 510 essentially equivalent to surfing naturally on an ocean wave. In this embodiment, it requires a surfing support means, for example a tether in the form of a rope 535. The rope 535 is designed to further support the surfer 70 during surfing. The rope 535 is fixed at one end 537 to the supporting structure 30, and the other end 539 is held by the surfer 70. Nozzles of the surfing device 500 are all angled to project fluid 40 in a predetermined directional range in a single general direction which forces the surfer 70 away from the direction that he or she is facing.

The projection of fluid 40 described above enables the surfer 70 to interact with the projected fluid 40 in a manner similar to that described above in relation to the other surfing devices and surf 76 over the surface 510. However, because the surface 510 is horizontal and flat, surfing 76 in relation to the surfing device 500 is only possible when the rope 535 is held by the surfer 70 via end 539. By holding the rope 535 in this manner, the surfer 70 maintains his or her position against the force of projected fluid 40. In doing so, the rope 535 becomes taut, as a result of at least partially constant tensioning, and the corresponding tension in the rope 535 enables the interaction described above.

Figure 10:
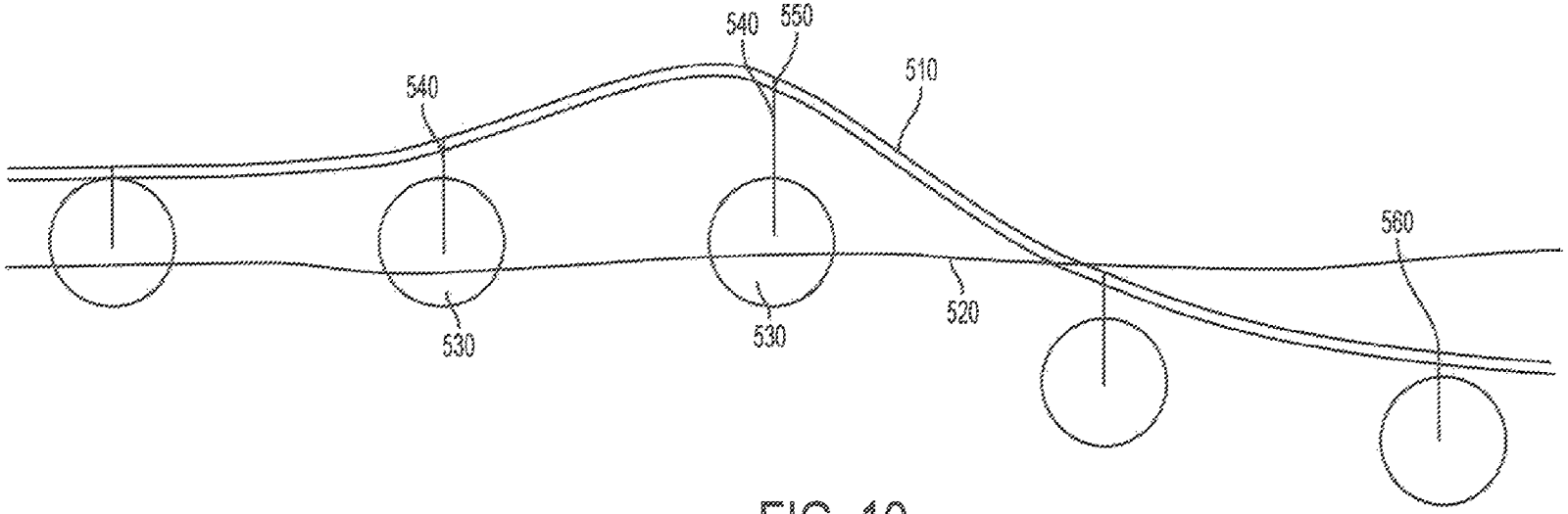
FIG. 10 is cross sectional view of an embodiment of surfing device of the present invention of FIG. 9 showing adjustment.

As shown in FIG. 10, the floats 530 include static adjustment in the form of static adjustment 540. This static adjustment enables adjustment between extreme float positions 550 and 560.

Another embodiment of surfing device without an energy recycling means is shown in FIG. 11, comprising at least one energy projecting means in the form of electromagnetic energy projecting plates 1100, a support structure 30 and all other features of a surfing device as discussed previously. Arrows represent electromagnetic energy 1200 projected by the plates 1100. Projected electromagnetic energy 1200 is another example of energy projection of the present invention that enables a person 70 to surf. The person 70 surfs entirely via contact with the projected energy 1200. The plates 1100 project electromagnetic energy 1200 from energy projecting positions comprising electromagnetic energy projecting positions 1250 which lie essentially flush with the surface 80.

Referring again to FIG. 11, surfing involves a planar object in the form of surfboard 1350. The surfboard 1350 has an appearance that resembles surfboard 100 described in FIG. 1A. However, the surfboard 1350 doesn't include the waved underneath surface 110 of surfboard 100. In place of the waved underneath surface 110, it has at least one electromagnetic energy receiving region in the form of metallic plates 1360. The surfboard 1350 is designed to receive the electromagnetic energy 1200. The design of the surfboard 1350 may also be adjusted according to user preferences, for example shape, thickness, weight, texture, stiffness. The electromagnetic energy has a concentration amount ranging from approximately 1,470.9975 Pa to approximately 4,903.325 Pa. This energy range relates to an active area of the surface 80 which is that area of the surface 80 which at any given instant is intended for the person 70 to surf over.

Interaction between the electromagnetic energy 1200 and the metallic plates 1360 enables the person 70 to surf upon the surface 1300. The surface 1300 of the surfing device is positioned above the surface 80. The surfer 70 surfs upon the surface 1300 without making significant contact with the surface 80. The surfer 70 therefore surfs 76 over the surface 80 essentially free from friction that would otherwise result from contact with the surface 80. The surfer 70 also surfs in a manner that is essentially natural and in a manner that is essentially equivalent to surfing on an ocean wave.

FIG. 12A to 12D disclose an embodiment of surfing device 1500 that includes an energy recycling means comprising an energy recycling module 1550. FIG. 13 is a perspective view of an embodiment of surfing device 1500 that includes an energy recycling means comprising an energy recycling module 1550. The energy recycling module 1550 recycles at least some of the projected fluid 40. The module 1550 is designed for projecting 1560 the recycled projection fluid from an additional energy projecting region positioned at a front region 1570 of the surface 80. At this front region 1570, the recycled projection fluid 1560 has a greater velocity and its velocity reduces as the recycled projection fluid 1560 moves over the ride surface 80 and away from the front region 1570.

The recycled projection 1560 interacts with the projected fluid 40. This interaction comprises providing a fluid layer 1580 over the surface 80 through which the nozzles 20 projecting the fluid 40; the layer 1580 providing a fluid environment which simulates a breaking ocean wave. A surfer is able to maneuver his or her surfboard in a manner similar to that the surfer would do to surf a breaking ocean wave and sink into the layer 1580. This enables the surfer to "bite" into the projected fluid 40 and subsequently control and maneuver his or her surfboard in a similar manner to what the surfer could do while surfing a breaking ocean wave.

The recycled projection 1560 may be adjustable statically, dynamically or both. This adjustment may also be multifaceted. For example, the position of corresponding nozzles 1590, their aperture and angle of projection are all adjustable. In one embodiment, the nozzles 1590 comprise rectangular or slot shaped apertures to produce a corresponding layer ranging from approximately 20 millimeters high for the narrowest opening to approximately 400 millimeters high when fully open. The projection angle may range from approximately 5 degrees to 35 degrees tangential to the surface 80.

As illustrated in FIG. 12B, the energy recycling module 1550 is also designed for recycled projection from other additional recycled projection positions that are proximal to the nozzles 20. The other additional recycled projection positions comprise nozzles 1610. Recycled projection 1600 from the nozzles 1610 adds to, and interacts with, the projected fluid 40. Contrary to the recycled projection 1560 shown in FIG. 12A, the projected fluid 40 and recycled projection 1600 in combination have a lower velocity at the front region 1570 and a higher velocity further removed from the front region 1570.

The recycled projection 1600 may also be adjustable statically, dynamically or both. This adjustment may also be multifaceted. The position of corresponding nozzles 1610 and their aperture and angle of projection are all adjustable. The aperture size of the nozzles 1610 ranges from approximately 50 to 5,000 square-millimeters. The projection angle ranges from approximately 5 to 175 degrees. The recycled projection 1600 may modify the angle of projection of the projected fluid 40. The projection angle may be modified, for example, to improve a surfer's ride experience. Therefore, recycled projection 1600, in addition to improving energy efficiency, provides the benefit of reducing forces which at least partially impair a surfer's surfing experience. For example, recycled projection 1600 may partially ameliorate gravitational and frictional forces.

Both static and dynamic fluid pressures are recycled by the energy recycling module 1550. The static fluid pressure comprises static pressure 1610 harvested by the module 1550 at a rear region 1620. The dynamic pressure 1630 is also harvested at a rear region 1620. Alternatively, in one embodiment, harvesting of the dynamic pressure 1630 may occur proximal to the nozzles 20.

FIGS. 12C and 12D disclose another embodiment of surfing device 1500 that includes an energy recycling means comprising an energy recycling module 1550 designed for both projecting the recycled projection fluid from an additional energy projecting region positioned at a front region 1570 and projecting additional recycled projection fluid from nozzles 1610 that are proximal to the nozzles 20.

FIG. 13 illustrate perspective view of an embodiment as disclosed in FIGS. 12C and 12D. The nozzles 20 are design to project energy in the form of fluid 40. Recycled projection through nozzles 1590 and 1610 interacts with the projected fluid 40. The projected fluid 40 enables a person 70 to surf 76. The person 70 surfs via direct contact with the fluid 40 and essentially independent of surface 80.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. By way of example, the energy recycling module could alternatively be integrally with the remainder of the ride, and the energy recycling module could also be designed to optimize the energy efficiency or surfing dynamics of the ride. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

What is claimed is:

1. A surfing device comprising:

a support structure, a ride surface, at least one energy projector configured to adjustably project an energy on the ride surface wherein the energy provides a surfing surface located at a distance from the ride surface, an energy relief mechanism configured to adjustably remove the energy from the ride surface, and a planar object for surfing comprising an upper surface, an underneath surface, a data receiving terminal, and a data emitting terminal; the data receiving terminal is configured to receive a plurality of data comprising the planar object's location and/or spatial orientation; the data emitting termination is configured to emit the plurality of data for adjusting the at least one energy projector and/or the energy relief mechanism;

the ride surface being supported by the support structure; and the at least one energy projector being located substantially flush with the ride surface, and being configured to project the energy at an angle relative to the ride surface.

2. The surfing device of claim 1 wherein the ride surface is further supported by a suspension element located underneath the ride surface; and the suspension element is configured to be supported by the support structure.

3. The surfing device of claim 1 wherein the ride surface comprises a plurality of segments.

4. The surfing device of claim 1 wherein the energy is in the form of a fluid or an electromagnetic energy.

5. The surfing device of claim 1 wherein the energy relief mechanism is configured to deform in shape upon physical impact.

6. The surfing device of claim 1 further comprising a floatation mechanism comprising one or more float elements connecting to the ride surface.

7. The surfing device of claim 1 wherein the underneath surface of a planner object comprising a wavy shape.

8. A surfing device comprising:

a support structure comprising a front end and a rear end, a ride surface comprising a first end and a second end, at least one energy projector configured to adjustably project a first energy on the ride surface wherein the energy provides a surfing surface located at a distance from the ride surface, at least one energy recycling mechanism configured to adjustably project a second energy on the ride surface wherein the second energy comprising at least a portion of the first energy, an energy relief mechanism configured to adjustably remove the first energy and/or second energy from the ride surface, and a planar object for surfing comprising an upper surface, an underneath surface, a data receiving terminal, and a data emitting terminal; the data receiving terminal is configured to receive a plurality of data comprising the planar object's location and/or spatial orientation; the data emitting termination is configured to emit the plurality of data for adjusting the at least one energy projector, the at least one energy recycling mechanism, and/or the energy relief mechanism;

the ride surface being supported by connecting the first end to the front end of the support structure and connecting the second end to the rear end of the support structure;

the at least one energy projector being located substantially flush with the ride surface, and being configured to project the first energy at an angle relative to the ride surface;

the at least one energy recycling mechanism is located proximal to the front end of the support structure and/or proximal to the at least one energy projector, wherein the second energy interacts with the first energy.

9. The surfing device of claim 6 wherein the ride surface is further supported by a suspension element located underneath the ride surface; and the suspension element is configured to be supported by the support structure.

10. The surfing device of claim 6 wherein the ride surface comprises a plurality of segments.

11. The surfing device of claim 6 wherein the energy is in the form of a fluid.

12. The surfing device of claim 6 wherein the energy relief mechanism is configured to deform in shape upon physical impact.

13. The surfing device of claim 6 wherein the underneath surface of a planner object comprising a wavy shape.

* * * * *